United States Patent [19]

Kato et al.

[11] Patent Number: 5,041,352

[45] Date of Patent: Aug. 20, 1991

[54] LIQUID DEVELOPER FOR ELECTROSTATIC PHOTOGRAPHY

[75] Inventors: Eiichi Kato; Kazuo Ishii; Hideyuki Hattori, all of Shizuoka, Japan

[73] Assignee: Fuji Photo Film Co., Ltd., Kanagawa, Japan

[21] Appl. No.: 473,535

[22] Filed: Feb. 1, 1990

[30] Foreign Application Priority Data

Feb. 3, 1989 [JP] Japan ..... 1-23920
Nov. 2, 1989 [JP] Japan ..... 1-285028

[51] Int. Cl.[5] ..... G03G 9/12
[52] U.S. Cl. ..... 430/114; 430/115
[58] Field of Search ..... 430/114, 115

[56] References Cited

U.S. PATENT DOCUMENTS 4,842,975 6/1989 Kato et al. ..... 430/114 X
4,977,055 12/1990 Kato et al. ..... 430/114

*Primary Examiner*—David Welsh
*Attorney, Agent, or Firm*—Sughrue, Mion, Zinn, Macpeak & Seas

[57] ABSTRACT

A liquid developer for electrostatic photography comprising a resin dispersed in a non-aqueous solvent having an electric resistance of at least $10^9$ Ωcm and a dielectric constant of not higher than 3.5, wherein the dispersed resin is a polymer resin obtained by polymerizing a solution containing at least one monofunctional monomer (A) which is soluble in the aforesaid non-aqueous solvent but become insoluble after being polymerized, in the presence of a dispersion-stabilizing resin which is soluble in the aforesaid non-aqueous solvent and at least one oligomer (B) having a number average molecular weight of not more than $1\times10^4$ and having at least one polar group selected from a carboxy group, a sulfo group, a hydroxy group, a formyl group, an amino group, a phosphono group, and

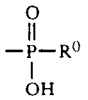

wherein $R^0$ represents a hydrocarbon group or $—OR^1$, (wherein $R^1$ represents a hydrocarbon group) bonded to only one terminal of the main chain of a polymer composed of a recurring unit represented by following formula (II):

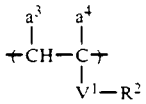

(II)

wherein $V^1$, $R^2$, $a^1$ and $a^2$ are as defined in the specification. The liquid developer is excellent in dispersion stability, re-dispersibility, and fixability, and also is capable of forming an offset printing plate having excellent ink-receptivitiy for printing ink and excellent printing durability by electrophotography.

10 Claims, No Drawings

LIQUID DEVELOPER FOR ELECTROSTATIC PHOTOGRAPHY

FIELD OF THE INVENTION

This invention relates to a liquid developer for electrophotography, which comprises a resin dispersed in a liquid carrier having an electric resistance of at least $10^9$ Ωcm and a dielectric constant of not higher than 3.5, and more particularly to a liquid developer excellent in re-dispersibility, storability, stability, image-reproducibility, and fixability.

BACKGROUND OF THE INVENTION

In general, a liquid developer for electrophotography is prepared by dispersing an inorganic or organic pigment or dye such as carbon black, nigrosine, phthalocyanine blue, etc., a natural or synthetic resin such as an alkyd resin, an acrylic resin, rosine, synthetic rubber, etc., in a liquid having a high electric insulating property and a low dielectric constant, such as a petroleum aliphatic hydrocarbon, and further adding a polarity-controlling agent such as a metal soap, lecithin, linseed oil, a higher fatty acid, a vinyl pyrrolidone containing polymer, etc. to the resulting dispersion.

In such a developer, the resin is dispersed in the form of insoluble latex grains having a grain size of from several μm to several hundred nm. In a conventional liquid developer, however, the soluble dispersion-stabilizing resin and the polarity-controlling agent are insufficiently bonded to the insoluble latex grains, so that the soluble dispersion-stabilizing resin and the polarity-controlling agent become freely dispersed in the liquid developer with ease. Accordingly, the soluble dispersion-stabilizing resin would be split off from the insoluble latex grains after storage of the liquid developer for a long period of time or after repeated use thereof, so that the grains would thereafter defectively precipitate, coagulate or accumulate, or the polarity would thereby become indistinct. Since the grains once coagulated and accumulated are reluctant to re-disperse, the grains would be adhered to everywhere in the developing machine, and, as a result, cause stain of images formed and malfunction of the developing machine such as clogging of the liquid-feeding pump.

In order to overcome such defects, a means of chemically bonding the soluble dispersion-stabilizing resin and the insoluble latex grains is disclosed in U.S. Pat. No. 3,990,980. However, the liquid developer disclosed was still insufficient, although the dispersion stability to spontaneous precipitation of the grains was improved in some degree. When the liquid developer was actually used in a developing apparatus, the toner adhered to parts of the apparatus and solidified to form a film thereon, and the thus solidified toner grains could hardly be redispersed. In addition, the solidified toner grains caused stain of the images duplicated and troubles in the apparatus. Accordingly, the liquid dispersion as disclosed in U.S. Pat. No. 3,990,980 was found to have a defect that the redispersion stability was still insufficient for practical use.

In accordance with the method of preparing the resin grains as disclosed in U S. Pat. No. 3,990,980, there is an extreme limitation on the combination of the dispersing stabilizer to be used and the monomers to be insolubilized, in order to prepare monodispersed grains having a narrow grain size distribution. Mostly, the resin grains prepared by the method would contain a large amount of coarse grains having a broad grain size distribution, or would be polydispersed grains having two or more different mean grain sizes. In accordance with such a method, it is difficult to obtain monodispersed grains having a narrow grain size distribution and having a desired mean grain size, and the method often results in large grains having a grain size of 1 μm or more, or extremely fine grains having a grain size of 0.1 μm or less. In addition, the dispersion stabilizer to be used in the method has another problem in that it must be prepared by an extremely complicated process requiring a long reaction time.

In order to overcome the aforesaid defects, a method of forming insoluble dispersion resin grains of a copolymer from a monomer to be insolubilized and a monomer containing a long chain alkyl moiety, so as to improve the dispersibility, re-dispersibility and storage stability of the grains, has been disclosed in JP-A-60-179751 and JP-A-62-151868 (the term "JP-A" as used herein means an "unexamined published Japanese patent application").

On the other hand, a method of printing a large number of prints of 5000 or more prints has recently been developed, using an offset printing master plate by electrophotography. In particular, because of further improvement of the master plate, it has become possible to print 10,000 or more prints of large size by electrophotography. In addition, noticeable progress has been made in shortening the operation time in an electrophotomechanical system, and the step of development-fixation in the system has been conveniently accelerated.

The grains prepared by the methods disclosed in aforesaid JP-A-60-179751 and JP-A-61-151868 might be good in the mono-dispersibility, re-dispersibility, and storage stability of the grains, but showed unsatisfactory performance with respect to the printability for master plates of a large size and quickening of the fixation time.

Also, the dispersion resin grains prepared by the methods disclosed in JP-A-60-185962 and JP-A-61-43757 were not always satisfactory in the points of the dispersibility and re-dispersibility of the grains and in the point of printability in the case of a shortened fixation time or in the case of master plates of a large size (e.g., A-3 size ($297\times420$ mm$^2$)) or larger.

SUMMARY OF THE INVENTION

This invention has been made for solving the aforesaid problems inherent in conventional liquid developers.

An object of this invention is to provide a liquid developer excellent in dispersion stability, redispersibility, and fixability, and in particular to provide a liquid developer excellent in dispersion stability, re-dispersibility, and fixability even in an electrophotomechanical system wherein the development-fixation step is quickened and master plates of a large size are used.

Another object of this invention is to provide a liquid developer capable of forming an offset printing plate having excellent ink-receptivity for printing ink and excellent printing durability by electrophotography.

Still another object of this invention is to provide a liquid developer suitable for various electrostatic photographies and various transfer systems in addition to the aforesaid uses.

A further object of this invention is to provide a liquid developer capable of being used for any liquid developer-using systems such as ink jet recording, cathode ray tube recording, and recording by pressure variation or electrostatic variation.

The aforesaid objects have been attained by the present invention as set forth hereinbelow.

That is, according to this invention, there is provided a liquid developer for electrostatic photography comprising a resin dispersed in a non-aqueous solvent having an electric resistance of at least $10^9$ Ωcm and a dielectric constant of not higher than 3.5, wherein the dispersed resin grains are copolymer resin grains obtained by polymerizing a solution containing at least one monofunctional monomer (A) which is soluble in the aforesaid non-aqueous solvent but becomes insoluble after being polymerized, in the presence of a dispersion-stabilizing resin which is soluble in the non-aqueous solvent and is a polymer having a recurring unit represented by following formula (I), a part of which has been crosslinked, and having an acid group selected from $-PO_3H_2$, $-SO_3H$, $-COOH$, $-OH$, $-SH$, and

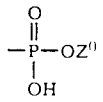

(wherein $Z^0$ represents a hydrocarbon group) bonded to only one terminal of at least one polymer main chain:

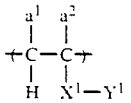

(I)

wherein $X^1$ represents —COO—, —OCO—, $-CH_2OCO-$, $-CH_2COO-$, —O—, or $-SO_2-$; $Y^1$ represents an aliphatic group having from 6 to 32 carbon atoms; and $a^1$ and $a^2$, which may be the same or different, each represents a hydrogen atom, a halogen atom, a cyano group, a hydrocarbon group having from 1 to 8 carbon atoms, $-COO-Z^1$ or $-COO-Z^1$ bonded via a hydrocarbon group having from 1 to 8 carbon atoms (wherein $Z^1$ represents a hydrocarbon group having from 1 to 22 carbon atoms); and at least one oligomer (B) having a number average molecular weight of not more than $10^4$ and having at least one polar group selected from a carboxy group, a sulfo group, a hydroxy group, a formyl group, an amino group, a phosphono group, and

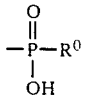

wherein $R^0$ represents a hydrocarbon group or $-OR^1$ (wherein $R^1$ represents a hydrocarbon group) bonded to only one terminal of the main chain of a polymer composed of a recurring unit represented by following formula (II):

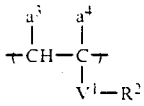

(II)

wherein $V^1$ represents —COO—, —OCO—, $-(CH_2)_l-COO-$, $-(CH_2)_l-OCO-$, —O—, $-SO_2-$, —CONHCOO—, —CONHCONH—,

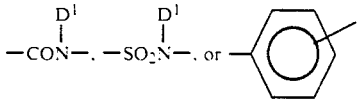

(wherein $D^1$ represents a hydrogen atom or a hydrocarbon group having from 1 to 22 carbon atoms and l represents an integer of from 1 to 3); $R^2$ represents a hydrocarbon group having from 1 to 22 carbon atoms, which may contain —O—, —CO—, $-CO_2-$, —OCO—, $-SO_2-$,

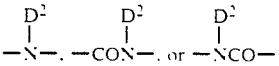

(wherein $D^2$ has the same significance as $D^1$ described above) in the carbon chain thereof; and $a^3$ and $a^4$, which may be the same or different, each represents a hydrogen atom, a halogen atom, a cyano group, a hydrocarbon group having from 1 to 8 carbon atoms, $-COO-D^3$, or $-COO-D^3$ bonded through a divalent hydrocarbon group having from 1 to 8 carbon atoms (wherein $D^3$ represents a hydrogen atom or a hydrocarbon group having from 1 to 8 carbon atoms which may be substituted).

DETAILED DESCRIPTION OF THE INVENTION

Then, the liquid developer of this invention is described in detail.

As the liquid carrier for the liquid developer of this invention having an electric resistance of at least $10^9$ Ωcm and a dielectric constant of not higher than 3.5, straight chain or branched aliphatic hydrocarbons, alicyclic hydrocarbons, aromatic hydrocarbons, and halogen-substituted derivatives thereof can be preferably used. Examples thereof are octane, isooctane, decane, isodecane, decalin, nonane, dodecane, isododecane, cyclohexane, cyclooctane, cyclodecane, benzene, toluene, xylene, mesitylene, Isopar E, Isopar G, Isopar H, Isopar L (Isopar is a trade name of Exxon Co.), Shellsol 70, Shellsol 71 (Shellsol is a trade name of Shell Oil Co.), Amsco OMS and Amsco 460 Solvent (Amsco is a trade name of American Mineral Spirits Co.). They may be used singly or as a combination thereof.

The non-aqueous dispersion resin grains (dispersed resin grains) (hereinafter often referred to as "latex grains") which are the most important constituting element in this invention are polymer resin grains obtained by polymerising (so-called a polymerization granulation method) the aforesaid monomer (A), in the presence of the dispersion-stabilizing resin which is a polymer having the recurring unit shown by the aforesaid formula (I), a part of the polymer chain of which has been crosslinked, and having an acid group selected from $-PO_3H_2$, —COOH, —OH, —SH, and

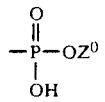

(wherein $Z^0$ represents a hydrocarbon gorup) bonded to one terminal only of at least one polymer main chain thereof, and the above-described oligomer (B) in a non-aqueous solvent.

As the non-aqueous solvent for use in this invention, any solvents miscible with the aforesaid liquid carrier for the liquid developer for electrostatic photography can be basically used in this invention.

That is, the non-aqueous solvent being used in the production of the dispersion resin grains may be any solvent miscible with the aforesaid liquid carrier and preferably includes straight chain or branched aliphatic hydrocarbons, alicyclic hydrocarbons, aromatic hydrocarbons, and halogen-substituted derivatives thereof. Specific examples thereof are hexane, octane, isooctane, decane, isodecane, decalin, nonane, isododecane, and isoparaffinic petroleum solvents such as Isopar E, Isopar G, Isopar H, Isopar L, Shellsol 70, Shellsol 71, Amsco OMS and Amsco 460. They may be used singly or as a combination thereof.

Other solvents which can be used together with the aforesaid organic solvent in this invention include alcohols (e.g., methanol, ethanol, propyl alcohol, butyl alcohol, and fluorinated alcohols), ketones (e.g., acetone, methyl ethyl ketone, and cyclohexanone), carboxylic acid esters (e.g., methyl acetate, ethyl acetate, propyl acetate, butyl acetate, methyl propionate, and ethyl propionate), ethers (e.g., diethyl ether, dipropyl ether, tetrahydrofuran, and dioxane), and halogenated hydrocarbons (e.g., methylene dichloride, chloroform, carbon tetrachloride, dichloroethane, and methyl chloroform).

It is preferred that the non-aqueous solvents which are used as a mixture thereof are distilled off by heating or under a reduced pressure after the polymerization granulation. However, even when the solvent is carried in the liquid developer as a dispersion of the latex grains, it gives no problem if the liquid electric resistance of the developer is in the range of satisfying the condition of at least $10^9$ Ωcm.

In general, it is preferred that the same solvent as the liquid carrier is used in the step of forming the resin dispersion and, as such a solvent, there are straight chain or branched aliphatic hydrocarbons, alicyclic hydrocarbons, aromatic hydrocarbons, halogenated hydrocarbons, etc., as described above.

The dispersion-stabilizing resin in this invention, which is used for forming a stable resin dispersion of the polymer insoluble in the non-aqueous solvent formed by polymerizing the monomer (A) in the non-aqueous solvent, is the polymer soluble in the non-aqueous solvent having the recurring unit shown by the aforesaid formula (I), a part of the polymer chain thereof having been crosslinked, and having an acid group selected from $—PO_3H_2$, $—SO_3H$, —COOH, —OH, —SH, and

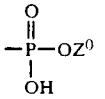

(wherein $Z^0$ represents a hydrocarbon group) bonded to one terminal only of at least one polymer main chain thereof.

Then, the recurring unit shown by the formula (I) is described in detail.

In the recurring unit shown by the formula (I), the aliphatic group and the hydrocarbon group may be substituted.

In the formula (I), $X^1$ represents preferably —COO—, —OCO—, $—CH_2OCO—$, $—CH_2COO—$, —O—, and more preferably —COO—, $—CH_2COO—$ or —O—.

In the formula (I), $Y^1$ represents preferably an alkyl group, an alkenyl group, or an aralkyl group each having from 8 to 22 carbon atoms, each may be substituted. Examples of the substituent are a halogen atom (e.g., fluorine, chlorine, and bromine), $—O—Z^2$, $—COO—Z^2$, and $—OCO—Z^2$ (wherein $Z^2$ represents an alkyl group having from 6 to 22 carbon atoms, such as hexyl, octyl, decyl, dodecyl, hexadecyl, octadecyl, etc.).

$Y^1$ represents more preferably an alkyl or alkenyl group having from 8 to 22 carbon atoms, such as octyl, decyl, dodecyl, tridecyl, tetradecyl, hexadecyl, octadecyl, docosanyl, octenyl, decenyl, dodecenyl, tetradecenyl, hexadecenyl, octadecenyl, etc.

In the formula (I), $a^1$ and $a^2$, which may be the same or different, each represents preferably a hydrogen atom, a halogen atom (e.g., fluorine, chlorine, and bromine), a cyano group, an alkyl group having from 1 to 3 carbon atoms, $—COO—Z^1$, or $—CH_2COO—Z^1$ (wherein, $Z^1$ represents an aliphatic group having from 1 to 22 carbon atoms, such as methyl, ethyl, propyl, butyl, hexyl, octyl, decyl, dodecyl, tridecyl, tetradecyl, hexadecyl, octadecyl, docosanyl, pentenyl, hexenyl, heptenyl, octenyl, decenyl, dodecenyl, tetradecenyl, hexadecenyl, octadecenyl, etc., and each of these groups may have the substituent as described above in respect of $Y^1$).

More preferably, $a^1$ and $a^2$ each represents a hydrogen atom, an alkyl group having form 1 to 3 carbon atoms (e.g., methyl, ethyl, and propyl), $—COO—Z^3$, or $—CH_2COO—Z^3$ (wherein $Z^3$ represents an alkyl or alkenyl group having from 1 to 12 carbon atoms, such as methyl, ethyl, propyl, butyl, hexyl, octyl, decyl, dodecyl, pentenyl, hexenyl, heptenyl, octenyl, decenyl, etc., and each of these alkyl and alkenyl groups may have the substituent as described above in respect of $Y^1$).

The dispersion-stabilizing resin in this invention, which is used for forming the stable resin dispersion of the polymer insoluble in the non-solvent formed by polymerizing the monomer (A) in the non-aqueous solvent is a polymer having at least one kind of the recurring units shown by the aforesaid formula (I), a part of which has been crosslinked, and having at least one kind of acid group selected from a carboxy group, a sulfo group, a phosphono group, a hydroxy group, a mercapto group, and

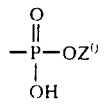

(wherein $Z^0$ represents preferably a hydrocarbon atom having from 1 to 18 carbon atoms and more preferably an aliphatic group having from 1 to 8 carbon atoms, which may be substituted (e.g., methyl, ethyl, propyl, butyl, hexyl, octyl, 2-chloroethyl, 2-methoxyethyl, butenyl, pentenyl, hexenyl, benzyl, phenethyl, bromobenzyl, methoxybenzyl, chlorobenzyl, methylbenzyl, cyclopentyl, and cyclohexyl) or an aryl group which may be substituted (e.g., phenyl, tolyl, xylyl, chlorophenyl, bromophenyl, methoxyphenyl, ethylphenyl, and methoxycarbonylphenyl)) bonded to only one terminal of at least one polymer chain thereof. The acid group has a chemical structure of being bonded to one terminal of the polymer main chain directly or via an optional linkage group.

The linkage group is composed of an optional combination of the atomic groups of a carbon-carbon bond (single bond or double bond), a carbon-hetero atom bond (examples of the hetero atom are oxygen, sulfur, nitrogen, and silicon), and a hetero atom-hetero atom bond. Examples of the linkage group are a sole linkage group selected from the atomic groups such as

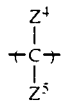

(wherein $Z^4$ and $Z^5$ each represents a hydrogen atom, a halogen atom (e.g., fluorine, chlorine, and bromine), a cyano group, a hydroxy group, or an alkyl group (e.g., methyl, ethyl, and propyl)), $\leftarrow CH=CH \rightarrow$,

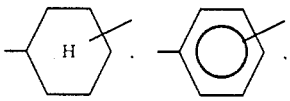

—O—, —S—,

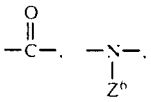

—COO—, $—SO_2—$,

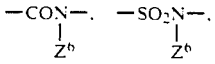

—NHCOO—, —NHCONH—, and

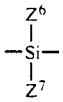

wherein $Z^6$ and $Z^7$, each represents a hydrogen atom or a hydrocarbon group having the same meaning as $Z^1$ in the formula (I) and a linkage group composed of an optional combination of the aforesaid atomic groups.

The polymer component of the dispersion-stabilizing resin in this invention contains a homopolymer component selected from the recurring units shown by the formula (I) or a copolymer component obtained by copolymerizing the monomer corresponding to the recurring unit shown by the formula (I), and other monomer polymerizable with the monomer corresponding to the recurring unit shown by the formula (I), a part of which has been crosslinked.

Examples of other monomer copolymerizable with the monomer corresponding to the recurring unit shown in the formula (I) are monomers corresponding to the recurring units shown by the formula (I), wherein $a^1$, $a^2$, and $X^1$ have the same meaning as those in the formula (I) and $Y^1$ is an aliphatic group having from 1 to 5 carbon atoms (e.g., methyl, ethyl, butyl, pentyl, cyclopentyl, 2-chloroethyl, 2-bromoethyl, 2-cyanoethyl, 3-chloropropyl, and 2-(methylsulfonyl)ethyl) or an aromatic group (e.g., phenyl tolyl, xylyl, chlorophenyl, bromophenyl, and fluorophenyl).

Further examples of other monomer copolymerizable with the monomer corresponding to the recurring unit shown by the formula (I) are acrylonitrile, methacrylonitrile, a heterocyclic compound having a polymerizable double bond (practically, the compounds same as the heterocyclic compounds described above in respect of the monomer (A)), and a compound having a carboxyamido group or a sulfoamido group and a polymerizable double bond (e.g., acrylamide, methacrylamide, diacetoneacrylamide, 2-carboxyamidoethyl methacrylate, vinylbenzenecarboxyamide, vinylbenzenesulfonamide, and 3-sulfonamidopropyl methacrylate).

In the dispersion-stabilizing resin for use in this invention, the proportion of the monomer corresponding to the recurring unit shown by the aforesaid formula (I) is properly from 40 to 100% by weight, and preferably from 60 to 100% by weight.

In the dispersion-stabilizing resin for use in this invention, for introducing a crosslinked structure into the polymer a conventionally known method can be utilized. That is, there are (1) a method of polymerizing the monomer in the co-existence of a polyfunctional monomer and (2) a method of giving a functional group proceeding a crosslinking reaction into the polymer to cause crosslinking by a high molecular reaction.

For the dispersion-stabilizing resin in this invention, a crosslinking reaction by a functional group having a self-crosslinking reactivity shown by the formula $—CONHCH_2OZ^8$ (wherein $Z^8$ represents a hydrogen or an alkyl group) or by polymerization from the view points that the reaction requires a long period of time, the reaction is not quantitative, and a reaction accelerator is used, which results in intermixing of impurities in the product).

In the polymerization reaction, a method of crosslinking the polymer chains by polymerizing a monomer having two or more polymerizing functional groups and the monomer corresponding to the recurring unit shown by the aforesaid formula (I) is preferred.

Practical examples of the polymerizable functional group are $CH_2=CH—$, $CH_2=CH—CH_2—$,

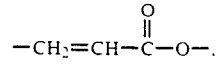

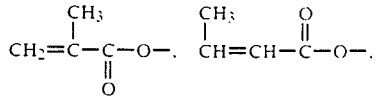

$CH_2=CH—CONH$,

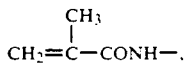

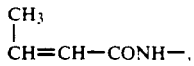

$CH_2{=}CH{-}O{-}C{-}$,

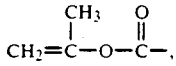

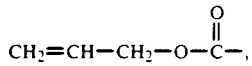

$CH_2{=}CH{-}NHCO{-}$, $CH_2{=}CH{-}CH_2{-}NHCO{-}$, $CH_2{=}CH{-}SO_2{-}$, $CH_2CH{-}CO{-}$, $CH_2{=}CH{-}O{-}$, and $CH_2{=}CH{-}S{-}$, and any monomers each having two or more same or different polymerizable functional groups can be used.

Practical examples of the monomer having two or more polymerizable functional groups are as follows.

That is, examples of the monomer having same polymerizable functional groups are styrene derivatives such as divinylbenzene, trivinylbenzene, etc.; methacrylic acid acrylic acid, or crotonic acid esters of polyhydric alcohols (e.g., ethylene glycol, diethylene glycol, triethylene glycol, polyethylene glycols #200, #400, and #600, 1,3-butylene glycol, neopentyl glycol, dipropylene glycol, polypropylene glycol, trimethylolpropane, trimethylolethane, and pentaerythritol) or polyhydroxyphenols (e.g., hydroquinone, resorcinol, catechol, and the derivatives thereof); vinyl ethers or allyl ethers; vinyl esters, allyl esters, vinylamides or allylamides of dibasic acids (e.g., malonic acid, succinic acid, glutaric acid, adipic acid, pimelic acid, malic acid, phthalic acid, and itaconic acid); and condensation products of polyamines (e.g., ethylenediamine, 1,3-propylenediamine, and 1,4-butylenediamine) and carboxylic acids having a vinyl group (e.g., methacrylic acid, acrylic acid, crotonic acid, and allylacetic acid).

Also, examples of the monomer having different polymerizable functional groups are ester derivatives or amide derivatives having a vinyl group (e.g., vinyl methacrylate, vinyl acrylate, vinyl itaconate, allyl acrylate, allyl itaconate, vinyl methacryloylacetate, vinyl methacryloylpropionate, ally methacryloylpropionate, methacrylic acid vinyloxycarbonyl methyl ester, acrylic acid vinyloxycarbonyl methyloxycarbonylethylene ester, N-allylacrylamide, N-allylmethacrylamide, N-allylitaconic acid amide, and methacryloylpropionic acid allyl amide) of carboxylic acids having a vinyl group [e.g., methacrylic acid, acrylic acid, methacryloylacetic acid, acryloylacetic acid, methacryloylpropionic acid, acryloylpropionic acid, itaconyloylpropionic acid, acryloylpropionic acid itaconyloylacetic acid, itaconyloylpropionic acid, and the reaction products of carboxylic anhydrides and alcohols or amines (e.g., allyloxycarbonylpropionic acid, allyloxycarbonylacetic acid, 2-allyloxycarbonylbenzoic acid, and allylaminocarbonylpropionic acid).

The dispersion-stabilizing resin soluble in the non-aqueous solvent, which is used in this invention, is formed by polymerizing the aforesaid monomers using the monomer having two or more polymerizable functional groups in a proportion of less than 15% by weight, and preferably less than 10% by weight of the whole monomers.

The dispersion-stabilizing resin in this invention having the aforesaid specific acid group bonded to one terminal of at least one polymer main chain can be easily prepared by (1) a method of reacting various reagents to the terminal of a living polymer obtained by an anion polymerization or a cation polymerization (a method by an ion polymerization), (2) a method of performing a radical polymerization using a polymerization initiator and/or a chain transfer agent each containing the specific polar group in the molecule (a method by a radical polymerization), or (3) a method of converting a reactive group bonded to the terminal of the polymer obtained by the aforesaid ion polymerization method or the radical polymerization method into the specific polar group in this invention by a macromolecular reaction.

Practically, the dispersion-stabilizing resin can be produced by the methods described in P. Dreyfuss & R. P. Quirk, *Encycl. Polym. Sci. Eng.*, 7, 551 (1987), Yoshiki Nakajo and Yuya Yamashita, *Senryo to Yakuhin* (*Dyes and Chemicals*), 39, 232 (1985), Akira Ueda and Susumu Nagai, *Kagaku to Kogyo* (*Science and Industry*), 60, 57 (1986), and the literature references cited therein.

The weight average molecular weight of the dispersion-stabilizing resin in this invention is preferably from $1\times10^4$ to $6\times10^5$, and more preferably from $2\times10^4$ to $3\times10^5$.

If the weight average molecular weight thereof is less than $1\times10^4$, the average grain size of the resin grains contained by the polymerization granulation become large (e.g., larger than 0.5 μm) and the grain size distribution becomes broad. Also, if the weight average molecular weight is over $6\times10^5$, the average grain size of the resin grains obtained by the polymerization granulation become large, thereby it becomes, sometimes, difficult to control the average grain size in the range of from 0.15 μm to 0.4 μm.

The polymer of the dispersion-stabilizing resin used in this invention can be practically produced by (1) a method of polymerizing a mixture of the monomer corresponding to the recurring unit shown by the formula (I), the aforesaid polyfunctional monomer, and a chain transfer agent having the acid group using a polymerization initiator (e.g., an azobis compound and a peroxide), (2) a method of polymerizing the aforesaid mixture using a polymerization initiator having the acid group without using the aforesaid chain transfer agent, (3) a method of polymerizing the aforesaid mixture using the chain transfer agent and the polymerization initiator each having the acid group, or (4) a method of performing each of the aforesaid three methods using a chain transfer agent or a polymerization initiator each having a functional group such as an amino group, a halogen atom, an epoxy group, an acid halide group, etc., as a substituent and thereafter introducing the acid group into the polymer formed by reacting with the above functional group with a monomer corresponding to the recurring unit represented by the formula (I) having the above acid group by a polymer reaction.

As the chain transfer agent being used, there are, for example, mercapto compounds having the acid group or a substituent capable of being induced to the acid group (e.g., thioglycolic acid, thiomalic acid, thiosalicylic acid, 2-mercaptopropionic acid, 3-mercaptopropionic acid, 3-mercaptobutyric acid, N-(2-mercaptopropionyl)glycine, 2-mercaptonicotinic acid, 3-[N-(2-mercaptoethyl)carbamoyl]propionic acid, 3-[N-(2-mercaptoethyl)amino]propionic acid, N-(3-mercaptopropionyl)alanine, 2-mercaptoethanesulfonic acid, 3-mercaptopropanesulfonic acid, 4-mercaptobutanesulfonic acid, 2-mercaptoethanol, 3-mercapto-1,2-propanediol, 1-mercapto-2-propanol, 3-mercapto-2-butanol, mercaptophenol, 2-mercaptoethylamine, 2-mercaptoimidazole, and 2-mercapto-3-pyridinol) and iodized alkyl compounds having the acid group or a substituent capable of being induced to the acid group (e.g., iodoacetic acid, iodopropionic acid, 2-iodoethanol, 2-iodoethanesulfonic acid, and 3-iodopropanesulfonic acid). In these compounds, the mercapto compounds are preferred.

Also, examples of the polymerization initiator having the acid group or a substituent capable of being induced to the acid group are 4,4-azobis(4-cyanovaleric acid), 4,4'-azobis(4-cyanovaleric acid chloride), 2,2'-azobis(2-cyanopropanol), 2,2'-azobis(2-cyanopentanol), 2,2'-azobis[2-(5-hydroxy-3,4,5,6-tetrahydropyrimidin-2-yl)propane], 2,2'-azobis{2-methyl—N-[1,1-bis(hydroxyamide}, 2,2'-azobis{2-methyl—N-[1,1-bis(hydroxymethyl)ethyl]propioamide}, 2,2' azobis[2-methyl—N-(2-hydroxyethyl propioamide], and 2,2'-azobis(2-aminopropane).

The chain transfer agent or the polymerization initiator is used in a proportion of from 0.1 to 15% by weight, and preferably from 0.5 to 10% by weight based on the total weight of the whole monomers.

It is supposed that the affinity of the dispersion-stabilizing resin in this invention produced as described above for a non-aqueous solvent is greatly improved by that the dispersion-stabilizing resin co-reacts with the insoluble resin grains by the acid group bonded to one terminal only of the polymer main chain and also the component which becomes soluble in the non-aqueous solvent has been crosslinked, and it is also considered that the occurrence of the aggregation and precipitation of the insoluble resin grains is restrained by the aforesaid matters to greatly improve the re-dispersibility of the dispersion-stabilizing resin.

The monomers which are used for the production of the non-aqueous dispersion resin grains can be classified into the monofunctional monomer (A) which is soluble in the non-aqueous solvent but becomes insoluble therein by being polymerized and the oligomer (B) forming a copolymer with the monomer (A).

The monomer (A) used in this invention includes any monofunctional monomers which are soluble in the non-aqueous solvent but become insoluble therein by being polymerized. Practically, monomers shown by, for example, the following formula (III) can be used in this invention.

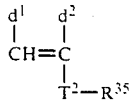

(III)

wherein $T^2$ represents —COO—, —OCO, —$CH_2$OCO—, —$CH_2$COO—, —O—,

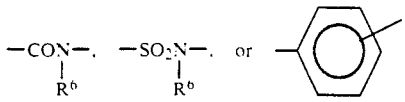

(wherein $R^6$ represents a hydrogen atom or an aliphatic group having from 1 to 18 carbon atoms, which may be substituted (e.g., methyl, ethyl, propyl, butyl, 2-chloroethyl, 2-bromoethyl, 2-cyanoethyl, 2-hydroxyethyl, benzyl, chlorobenzyl, methylbenzyl, methoxybenzyl, phenethyl, 3-phenylpropyl, dimethylbenzyl, fluorobenzyl, 2-methoxyethyl, and 3-methoxypropyl)), $R^{35}$ represents a hydrogen atom or an aliphatic group having from 1 to 6 carbon atoms, which may be substituted (e.g., methyl, ethyl, propyl, butyl, 2-chloroethyl, 2,2-dichloroethyl, 2,2,2-trifluoroethyl, 2-bromoethyl, 2-glycidylethyl, 2-hydroxyethyl, 2-hydroxypropyl, 2,3-dihydroxypropyl, 2-hydroxy-3-chloropropyl, 2-cyanoethyl, 3-cyanopropyl, 2-nitroethyl, 2-methoxyethyl, 2-methanesulfonylethyl, 2-ethoxyethyl, N,N-dimethylaminoethyl, N,N-diethylaminoethyl, trimethoxysilylpropyl, 3-bromopropyl, 4-hydroxybutyl, 2-furfurylethyl, 2-thienylethyl, 2-pyridylethyl, 2-morpholinoethyl, 2-carboxyethyl, 3-carboxypropyl, 4-carboxybutyl, 2-phosphoethyl, 3-sulfopropyl, 4-sulfobutyl, 2-carboxyamidoethyl, 3-sulfoamidopropyl, 2-N-methylcarboxyamidoethyl, cyclopentyl, chlorocyclohexyl, and dichlorohexyl), and $d^1$ and $d^2$, which may be the same or different, each has the same meaning as $a^3$ or $a^4$ in the formula (II) described above.

Specific examples of the monomer (A) are vinyl esters or allyl esters of an aliphatic carboxylic acid having from 1 to 6 carbon atoms (e.g., acetic acid, propionic acid, butyric acid, monochloric acid, trifluoropropionic acid); alkyl esters or amides having from 1 to 4 carbon atoms, which may be substituted, of an unsaturated carboxylic acid such as acrylic acid, methacrylic acid, crotonic acid, itaconic acid, maleic acid, etc., (examples of the alkyl moiety are methyl, ethyl, propyl, butyl, 2-chloroethyl, 2-bromoethyl, 2-fluoroethyl, trifluoroethyl, 2-hydroxyethyl, 2-cyanoethyl, 2-nitroethyl, 2-methoxyethyl, 2-methanesulfonylethyl, 2-benzenesulfonylethyl, 2-(N,N-dimethylamino)ethyl, 2-(N,N-diethylamino)ethyl, 2-carboxyethyl, 2-phosphoethyl, 4-carboxybutyl, 3-sulfopropyl, 4-sulfobutyl, 3-chloropropyl, 2-hydroxy-3-chloropropyl, 2-furfurylethyl 2-pyridinylethyl, 2-thienylethyl, trimethoxysilylpropyl, and 2-carboxyamidoethyl); styrene· derivatives e.g., styrene, vinyltoluene, α-methylstyrene, vinylnaphthalene, chlorostyrene, dichlorostyrene, bromostyrene, vinylbenzenecarboxylic acid, vinylbenzenesulfonic acid, chloromethylstyrene, hydroxymethylstyrene, methoxymethylstyrene, N,N-dimethylaminomethylstyrene, vinylbenzenecarboxyamide, an vinylbenzenesulfonamide); unsaturated carboxylic acids such as acrylic acid, methacrylic acid, crotonic acid, maleic acid, itaconic acid, etc.; cyclic anhydrides of maleic acid and itaconic acid; acrylonitrile; methacrylonitrile and heterocyclic compounds having a polymerizable double bond group (practically, the compounds described in *Polymer Data Handbook, Foundation* pages 175–184, edited by Polymer Society of Japan, published by Baifukan, 1986, such as N-vinylpyridine, N-vinylimidazole, N-vinylpyrrolidone, vinylthiophene, vinyltetrahydrofuran, vinyloxazoline, vinylthiazole, N-vinylmorpholine, etc.

The aforesaid monomers (A) may be used singly or as a mixture thereof.

The oligomer (B) used in this invention is an oligomer having a number average molecular weight of not more than $1\times10^4$ and having the specific polar group described above bonded to only one terminal of the main chain of the polymer composed of the recurring unit shown by the aforementioned formula (II).

In formula (II) described above, the hydrocarbon groups contained in $a^3$, $a^4$, $V^1$, and $R^2$ include, for example, an alkyl group, an alkenyl group, an alicyclic group and an aryl group, each having the carbon atom number (as unsubstituted hydrocarbon group) indicated above, and these hydrocarbon groups may be substituted.

In formula (II), $D^1$ in the groups shown by $V^1$ represents a hydrogen atom or a hydrocarbon group and examples of the preferred hydrocarbon group are an alkyl group having from 1 to 22 carbon atoms, which may be substituted (e.g., methyl, ethyl, propyl, butyl, heptyl, hexyl, octyl, nonyl, decyl, dodecyl, tridecyl, tetradecyl, hexadecyl, octadecyl, eicosanyl, docosanyl, 2-chloroethyl, 2-bromoethyl, 2-cyanoethyl, 2-methoxycarbonylethyl, 2-methoxyethyl, and 3-bromopropyl), an alkenyl group having from 4 to 18 carbon atoms, which may be substituted (e.g., 2-methyl-1-propenyl, 2-butenyl, 2-pentenyl, 3-methyl-2-pentenyl, 1-pentenyl, 1-hexenyl, 2-hexenyl, 4-methyl-2-hexenyl, decenyl, dodecenyl, tridecenyl, hexadecenyl, and linolenyl), an aralkyl group having from 7 to 12 carbon atoms, which may be substituted (e.g., benzyl, phenethyl, 3-phenylpropyl, chlorobenzyl, bromobenzyl, methylbenzyl, ethylbenzyl, methoxybenzyl, dimethylbenzyl, and dimethoxybenzyl), an alicyclic group having from 5 to 8 carbon atoms, which may be substituted (e.g., cyclohexyl, 2-cyclohexylethyl, and 2-cyclopentylethyl), and an aromatic group having from 6 to 12 carbon atoms, which may be substituted (e.g., phenyl, naphthyl, tolyl, xylyl, propylphenyl, butylphenyl, octylphenyl, dodecylphenyl methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylpheny, butoxycarbonylphenyl, acetamidophenyl, propioamidophenyl, and dodecyloylamidophenyl).

When $V^1$ represents

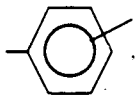

the benzene ring may have a substituted such as a halogen atom (e.g., chlorine and bromine), an alkyl group (e.g., methyl, ethyl, propyl, butyl, chloromethyl, and methoxymethyl), etc.

In formula (I), $R^2$ represents preferably a hydrocarbon group having form 1 to 22 carbon atoms and practically the aforesaid hydrocarbon groups on $D^1$. $R^2$ may contain in the carbon chain —O—, —CO—, —$CO_2$—, —$SO_2$—, $$-\overset{D^2}{\overset{|}{N}}-,\ -\overset{D^2}{\overset{|}{CON}}-,\ \text{or}\ -\overset{D^2}{\overset{|}{NCO}}-$$

(wherein $D^2$ has the same meaning as $D^1$).

In formula (II), $a^3$ and $a^4$, which may be the same or different, each represents preferably a hydrogen atom, a halogen atom (e.g., chlorine and bromine), a cyano group, an alkyl group having from 1 to 3 carbon atoms (e.g., methyl, ethyl, and propyl), —COO—$D^3$, or —$CH_2COOD^3$ (wherein $D^3$ represents a hydrogen atom, an alkyl group having from 1 to 18 carbon atoms, an alkenyl group, an aralkyl group, an alicyclic group, or an aryl group, each of these groups may be substituted, and practical examples of these groups are the same as those described above for $D^1$).

Furthermore, in a preferred embodiment of this invention, $R_2$ in the recurring unit shown by the aforesaid formula (II) in the oligomer (B) used in this invention is a component containing at least one specific polar group and, thus, the recurring unit contains at least two such specific polar groups in the molecule. Examples of such recurring units are represented by the following formula (IIa):

$$\left(\overset{a^3}{\overset{|}{CH}}-\overset{a^4}{\overset{|}{C}}\right)_{V^1\left(W^1-X^1\right)_m\left(W^2-X^2\right)_n R^2} \qquad \text{(IIa)}$$

wherein $a^3$, $a^4$, m, and $V^1$ have the same meanings as those described for Formula (I); $X^1$ and $X^2$, which may be the same or different, each represents —O—, —CO—, —$CO_2$—, —$SO_2$—, $$-\overset{D^5}{\overset{|}{N}}-,\ -\overset{D^5}{\overset{|}{CON}}-,\ \text{or}\ -\overset{D^5}{\overset{|}{NCO}}-$$

(wherein $D^5$ has the same meaning as $D^1$ in formula (II)); $W^1$ and $W^2$, which may be the same or different, each represents a hydrocarbon group having from 1 to 18 carbon atoms (examples of the hydrocarbon group are an alkyl group, an alkenyl group, an aralkyl group, or an alicyclic group) which may be substituted or may have $$\left(\overset{|}{CH}\right)_{X^3\left(W^3-X^4\right)_p R^5}$$

in the main chain bond. Preferred examples of the aforesaid aliphatic groups have the same meaning as the preferred aliphatic groups of $R^2$ in formula (II) described above.

In the aforesaid formula, $X^3$ and $X^4$, which may be the same or different, each has the same meaning as aforesaid $X^1$ or $X^2$ and $W^3$ has the hydrocarbon group having from 1 to 18 carbon atoms, which may be substituted, having the same meaning as $W^1$ or $W^2$ described above.

More practically, $W^1$ and $W^2$ in formula (IIa) each is composed of an optional combination of the atomic groups of $$\overset{D^8}{\overset{|}{\underset{D^7}{\underset{|}{C}}}}$$

(wherein $D^7$ and $D^8$ each represents a hydrogen atom, an alkyl group, or a halogen atom),

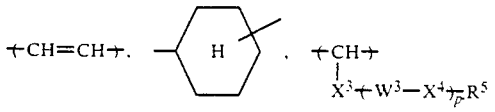

wherein $X^3$, $X^4$ and $W^3$ have the same meaning as defined above.

Moreover, in the aforesaid formulae, m, n, and p, which may be the same or different, each represents 0, 1, 2, or 3, with the proviso that m, n and p cannot be 0 at the same time.

In the aforesaid formulae, $R^5$ represents a hydrogen atom or a hydrocarbon group having from 1 to 22 carbon atoms, is preferably an aliphatic group having from 1 to 22 carbon atoms, which may be substituted, and has practically the same meaning as $R^2$ in formula (II).

Furthermore, it is preferred that the sum of the atoms in each atomic group of $V^1$, $W^1$, $X^1$, $W^2$, or $R^5$ in formula (IIa) is composed of at least 8.

Then, specific examples of the recurring unit shown by formula (IIa) are illustrated below but the scope of the invention is not limited thereto.

In addition, in the following formulae, a represents —H or —$CH_3$; R represents an alkyl group having from 1 to 18 carbon atoms; R′ represents a hydrogen atom or an alkyl group having from 1 to 18 carbon atoms; $k_1$ and $k_2$ each represents an integer of from 1 to 12; and $l_1$ represents an integer of from 1 to 100.

(A)-1

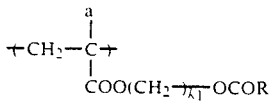

(A)-2

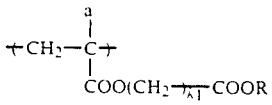

(A)-3

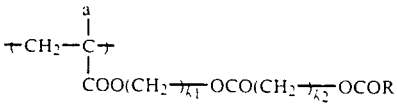

(A)-4

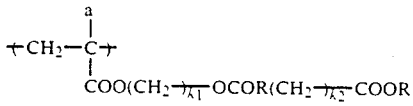

(A)-5

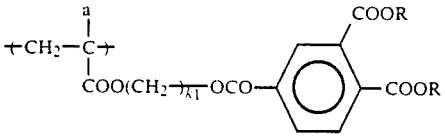

(A)-6

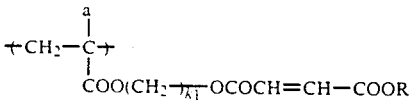

(A)-7

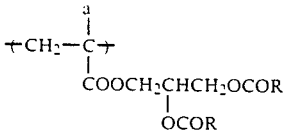

-continued (A)-8

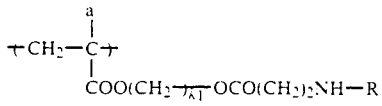

(A)-9

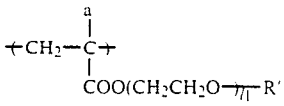

(A)-10

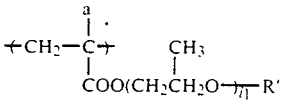

(A)-11

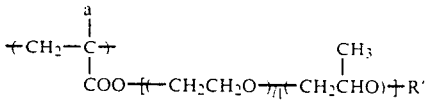

(A)-12

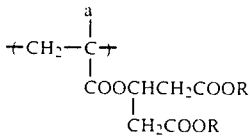

(A)-13

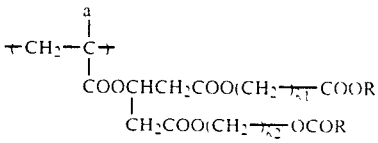

(A)-14

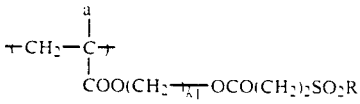

(A)-15

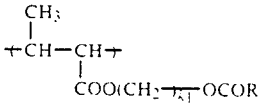

(A)-16

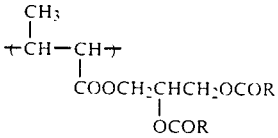

(A)-17

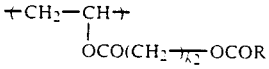

(A)-18

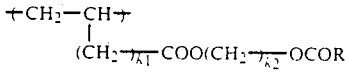

In the polar group

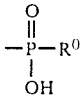

bonded to only one terminal of the main chain of the polymer having a number average molecular weight of not more than $1\times10^4$ and having at least one recurring unit shown by aforesaid formula (II), $R^0$ represents —$R^1$ or —$OR^1$ (wherein $R^1$ represents a hydrocarbon group having from 1 to 18 carbon atoms). Preferred examples of the hydrocarbon group shown by $R^1$ are an aliphatic group having from 1 to 8 carbon atoms, which may be substituted (e.g., methyl, ethyl, propyl, butyl, pentyl, hexyl, butenyl, pentenyl, hexenyl, 2-chloroethyl, 2-cyanoethyl, cyclopentyl, cyclohexyl, benzyl, phenethyl, chlorobenzyl, and bromobenzyl}or an aromatic group which may be substituted (e.g., phenyl, tolyl, xylyl, mesityl, chlorophenyl, bromophenyl, methoxyphenyl and cyanophenyl).

Also, the amino group as the polar group in this invention is $-NH_2$, $-NHR^9$, or

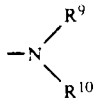

(wherein $R^9$ and $R^{10}$ each represents a hydrocarbon group having from 1 to 18 carbon atoms, and preferably from 1 to 8 carbon atoms, and practically the same as the hydrocarbon groups shown by $R^1$ described above).

More preferably, the hydrocarbon group shown by $R^1$, $R^9$, or $R^{10}$ is an alkyl group having from 1 to 4 carbon atoms, which may be substituted, a benzyl group which may be substituted, or a phenyl group which may be substituted.

The polar group is bonded to one terminal of the main chain of the polymer directly or via an optional linkage group. The group linking the moiety (recurring unit) of formula (II) and the polar group is composed of an optional combination of the atomic group of a carbon-carbon bond (single bond or double bond), a carbon-hetero atom bond (examples of the hetero atom are oxygen, sulfur, nitrogen, and silicon), or a hetero atom-hetero atom bond.

Preferred oligomers in the oligomer (B) for use in this invention are shown by following formula (VIa) or (VIb);

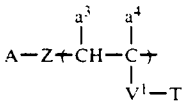

(VIa)

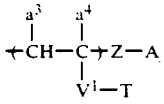

(VIb)

wherein $a^3$, $a^4$, and $V^1$ are the same as those in formula (II) and T represents $R^5$ in formula (II) or $\text{-}(W^1)\text{-}X^1)_m(W^2\text{-}X^2)_nR^5$ in formula (IIa).

Also, in the aforesaid formulae, A represents the aforesaid polar group bonded to one terminal in formula (II) and Z represents a simple bond, a linkage group selected from the atomic groups of

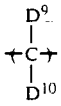

(wherein $D^9$ and $D^{10}$ each, independently, represents a hydrogen atom, a halogen atom (e.g., fluorine, chlorine, and bromine), a cyano group, a hydroxy group, or an alkyl group (e.g., methyl, ethyl, and propyl)), $\text{-}(CH=CH)\text{-}$, CH-,

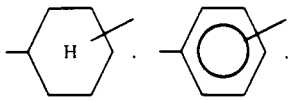

—O—, —S—,

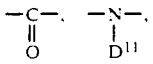

—COO—, $-SO_2-$,

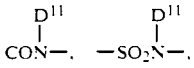

—NHCO—, —NHCONH—,

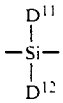

(wherein $D^{11}$ and $D^{12}$ each, independently, represents a hydrogen atom or the hydrocarbon group as that of $D^1$ described above), etc., or a linkage group composed of an optional combination of the aforesaid atomic group.

If the number average molecular weight of the oligomer (B) is more than $1\times10^4$, the printing resistance of the printing plate obtained using the liquid developer is lowered. On the other hand, if the molecular weight it too small, there is a tendency of causing stains and hence the number average molecular weight of the oligomer (B) is preferably higher than $1\times10^3$.

The oligomer (B) for use in this invention is composed of a homopolymer component or a copolymer component selected from the recurring units shown by formula (II) or a copolymer component obtained by the copolymerization of a monomer corresponding to the recurring unit shown by formula (II) and other monomer copolymerizable with said monomer.

Other monomers which can be a copolymer component together with the polymer component of formula (II) include, for example, acrylonitrile, methacrylonitrile, a heterocyclic compound having a polymerizable double bond group (practically, the compounds same as the heterocyclic compounds described above for the monomer (A)), and a compound having a carboxyamido group or a sulfoamido group and a polymerizable double bond group (e.g., acrylamide, methacrylamide, diacetoneacrylamide, 2-carboxyamidoethyl methacrylate, vinylbnzenecarboxyamide, vinylbenzenesulfoamide, and 3-sulfoamidopropyl methacrylate).

The proportion of the recurring unit represented by aforesaid formula (II) or (IIa) in the oligomer (B) can be suitably from about 30% to about 100% by weight, and preferably from 50% to 100% by weight.

Also, it is preferred that the main chain of the polymer does not contain a copolymer component containing the polar group such as a phosphono group, a carboxy group, a sulfo group, a hydroxy group, a formyl group, an amino group, and

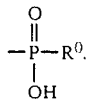

The oligomer (B) for use in this invention having the specific polar group bonded to only one terminal of the polymer main chain can be easily prepared by (1) a method of reacting various reagents with the terminal of a living polymer obtained by an anion polymerization or a cation polymerization (a method by ion polymerization), (2) a method of performing a radical polymerization using a polymerization initiator and/or a chain transfer agent containing a specific polar group in the molecule (a method by radical polymerization), or (3) a method of converting a reactive group bonded to the terminal of the polymer obtained by the aforesaid ion polymerization method or the radical polymerization method into the specific polar group in this invention by a macromolecular reaction.

Practically, the oligomer can be produced by the methods described in P. Drefuss and R. P. Quirk, *Encyl. Polym. Sci. Eng*, 7, 551(1987), Yoshiki Nakajo and Yuya Yamashita, *Senryo to Yakuhin* (*Dyes and Chemicals*), 30, 232(1985), Akira Ueda and Susumu Nagai, *Kagaku to Kogyo* (*Science and Industry*), 60, 57(1986), and the literatures cited in these literature references.

Examples of the polymerization initiator having the aforesaid specific polar group in the molcule are 4,4'-azobis(4-cyanovaleric acid), 4,4'-azobis(cyanovaleric acid chloride), 2,2'-azobis(2-cyanopropanol), 2,2'-azobis(2-cyanopentanol), 2,2'-azobis [2-methyl-N-(2-hydroxyethyl)propioamide], 2,2'-azobis{2-methyl-N-[1,1-bis(hydroxymethyl)ethyl]propioamide}, 2,2'-azobis-{3-methyl-N-[1,1-bis(hydroxymethyl)-2-hydroxyethyl]propioamide}, 2,2'-azobis[2-(5-methyl-2-imidazolin-2-yl)propane], 2,2'-azobis[2-(4,5,6,7-tetrahydro-1H-1,3-diazepin-2-yl)propane], 2,2'-azobis[2-(3,4,5,6-tetrahydropyrimidin-2-yl)propane], 2,2'-azobis[2-(5-hydroxy3,4,5,6-tetrapyrimidin-2-yl)propane], 2,2'-azobis{2-[1(2-hydroxyethyl)-2-imidazolin-2-yl]propane}, 2,2'-azobis[N-(2-hydroxyethyl)-2-methylpropionamidine], and 2,2'-azobis[N-(4-aminophenyl)-2-methylpropionamidine].

Also, the chain transfer agent having the specific polar group in the molecule includes, for example, mercapto compounds, disulfide compounds, and iodide-substituted compounds but mercapto compounds are preferred. Examples thereof are thioglycolic acid, 2mercaptopropionic acid, thiomalic acid, 2-mercaptoethanesulfonic acid, 2-mercaptoethanol, 2-mercaptoethylamine, thiosalicyclic acid, α-thioglycerol, 2-phosphonoethylmercaptan, hydroxythiophenol, and derivatives of these mercapto compounds.

The amount of the polymerization initiator and/or the chain transfer agent is from about 0.5% to about 20% by weight, and preferably from 1% to 10% by weight based on the total amount of the monomer corresponding to the recurring unit shown by formula (I) and other polymerization monomer(s).

As the oligomer (B) used in this invention, the oligomer shown by formula (VIa) or (VIb) described above is preferred, and specific examples of the moiety shown by A—Z— in these formulae are shown below but the scope of this invention is not limited thereto.

In addition, in the following formulae, $k_1$ represents 1 or 2; $k_2$ represents an integer of from 2 to 16; and $k_3$ represents 1 or 3.

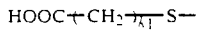

(B)-1

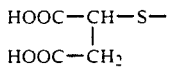

(B)-2

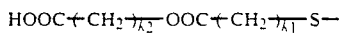

(B)-3

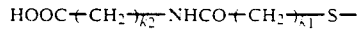

(B)-4

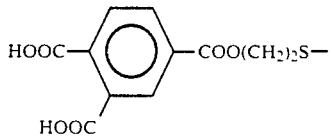

(B)-5

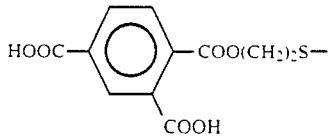

(B)-6

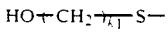

(B)-7

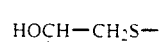

(B)-8

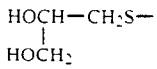

(B)-9

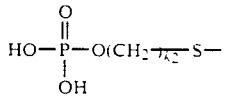

(B)-10

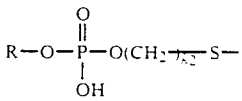

(B)-11

R: an alkyl group having 1 to 6 carbon atoms

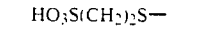

(B)-12

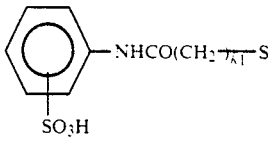

(B)-13

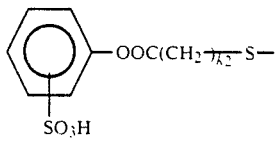

(B)-14

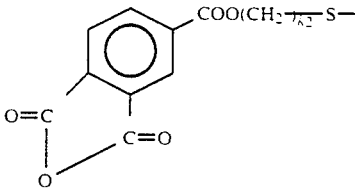

(B)-15

-continued (B)-16

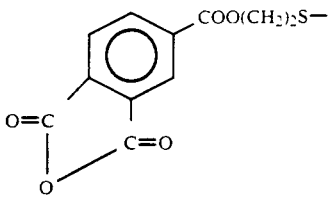

(B)-17

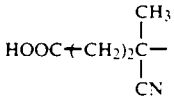

(B)-18

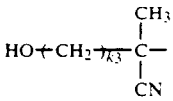

(B)-19

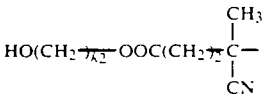

(B)-20

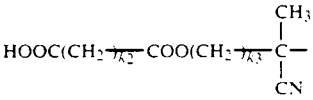

(B)-21

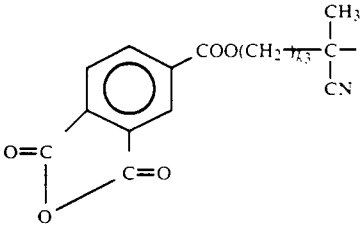

(B)-22

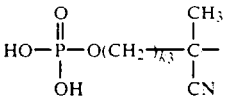

(B)-23

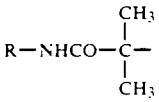

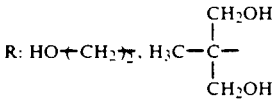

(B)-24

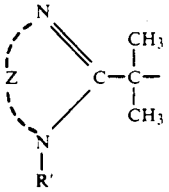

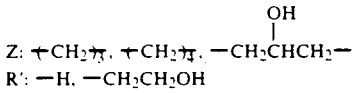

(B)-25

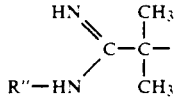

-continued

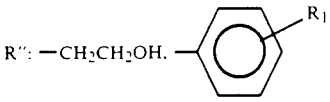

(B)-26

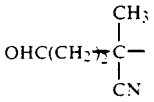

(B)-27

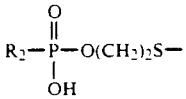

$R_2$: an alkyl group having 1 to 6 carbon atoms (B)-28

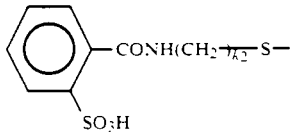

(B)-29

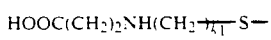

(B)-30

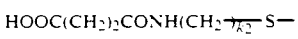

The dispersion resin for use in the liquid developer of this invention is composed of at least one kind of the monomer (A) and at least one kind of the oligomer (B) and it is important that the resin produced from the aforesaid components is insoluble in the aforesaid non-aqueous solvent and in such a case, the desired dispersion resin can be obtained.

More specifically, the oligomer (B) shown by formula (II) is used in an amount of preferably from about 0.05 to about 10%, more preferably from 0.1 to 5% by weight, and most preferably from 0.3 to 3% by weight based on the monomer (A) used for insolubilizing the resin formed in the aforesaid non-aqueous solvent. Also, the molecular weight of the dispersion resin for use in this invention is from about $10^3$ to about $10^6$, and preferably from $1\times10^4$ to $5\times10^5$.

For producing the dispersion resin for use in this invention, the aforesaid dispersion stabilizing resin, the monomer (A), and the oligomer (B) may be polymerized by heating in the non-aqueous solvent in the presence of a polymerization initiator such as benzoyl peroxide, azobisisobutyronitrile, butyllithium, etc.

More specifically, the dispersion resin can be produced by (1) a method of adding the polymerization initiating agent to a solution composed of the dispersion stabilizing agent, the monomer (A), and the oligomer (B), (2) a method of adding dropwise the monomer (A) and the oligomer (B) together with a polymerization initiator to a solution of the dispersion stabilizing resin, (3) a method of optionally adding a part of a mixture of the monomer (A) and the oligomer (B) together with a polymerization initiator to a solution containing a whole amount of the dispersion stabilizing resin and the remaining mixture of the monomer (A) and the oligomer (B), or (4) a method of optionally adding a solution of the dispersion stabilizing resin, the monomer (A}, and the oligomer (B) together with a polymerization initiator to the non-aqueous solvent.

The total amount of the monomer (A) and the oligomer (B) is from about 5 to about 80 parts by weight, and preferably from 10 to 50 parts by weight per 100 parts by weight of the non-aqueous solvent.

The amount of the soluble resin which is the dispersion stabilizing resin for the liquid developer of this invention is from about 1 to about 100 parts by weight, and preferably from 5 to 50 parts by weight per 100 parts by weight of the total amount of the monomers.

The amount of the polymerization initiator used is typically from about 0.1 to about 5% by weight based on the total amount of the monomers Also, the polymerization temperature is from about 50° C. to about 180° C., and preferably from 60° C. to 120° C. The reaction time is preferably from 1 to 15 hours.

When the above-mentioned polar solvent such as alcohols, ketones, ethers, esters, etc., is used together with the non-aqueous solvent in the reaction or when the unreacted monomer (A) remains without being polymerization-granulated, it is preferred that the polar solvent or the unreacted monomer is distilled off by heating the reaction mixture to a temperature higher than the boiling point of the polar solvent or the monomer, or is distilled off under reduced pressure The non-aqueous dispersion resin (or non-aqueous latex grains) prepared as described above exists as fine grains having a uniform grain size distribution and, at the same time, shows a very stable dispersibility. In particular, even when the liquid developer of the invention containing the non-aqueous dispersion resin grains (or the non-aqueous latex grains) is repeatedly used for a long period of time in a development apparatus, the dispersibility of the resin in the developer is well maintained. Also, even when the developing speed is increased, the re-dispersion of the resin in the liquid developer is easy and no occurrence of stains by sticking of the resin grains to parts of the developing apparatus is observed under such a high load condition.

Also, when the resin grains are fixed by heating, a strong film is formed, which shows that the dispersion resin has an excellent fixability.

Furthermore, even when the liquid developer of this invention is used in the process of a quickened development-fix step using a master plate of a large size, the dispersion stability, the re-dispersibility, and fixability are excellent.

The reason why the re-dispersibility and the fixability of the toner images are remarkably improved as described above in the case of using the resin grains in this invention for the liquid developer has not yet been clarified. However, it has been observed that, even when the oligomer (B) was added after performing the polymerization gradulation without using the oligomer (B), the aforementioned effects were not obtained. Thus, it is considered that in the resin grains of this invention, the oligomer (B) used in the polymerization granulation improves the surface property of the resin grains.

That is, it is considered to be one of the main factors that, during the polymerization granulation carried out in a non-aqueous solvent, the specific polar group bonded only to one terminal of the main chain of the oligomer is adsorbed onto the resin grains by an anchor effect, whereby the main chain portion of the polymer improves the surface property of the resin grains to improve the affinity of the resin grains for the dispersion medium.

The liquid developer of this invention may contain, if desired, a colorant.

There is no specific restriction on the colorant being used, and any conventional pigments or dyes can be used as the colorant in this invention.

When the dispersion resin itself is to be colored, for example, a pigment or dye is physically dispersed in the dispersion resin as one method, and various kinds of pigments and dyes are known, which can be used in the method. Examples of such pigments and dyes include a magnetic iron powder, a lead iodide powder, carbon black, nigrosine, alkali blue, hansa yellow, quinacridone red, and phthalocyanine blue.

As another method of coloring the liquid developer, the dispersion resin may be dyed with a desired dye, for example, as disclosed in JP-A-57-48738. As still other methods, the dispersion resin may be chemically bonded to a dye, for example, as disclosed in JP-A-53-54029; or a previously dye-containing monomer is used in polymerizing granulation to obtain a dye-containing polymer, for example, as disclosed in JP-B-44-22955 (the term "JP-B" as used herein means an "examined Japanese patent publication").

Various additives may be added to the liquid developer of the present invention so as to enhance the charging characteristic or to improve the image-forming characteristic. For example, the substances described in Yuji Harasaki, *Electrophotography*, Vol. 16, No. 2, page 44 can be used for such purpose.

Specifically, useful additives include metal salts of 2-ethylhexylsulfosuccinic acid, metal salts of naphthenic acid, metal salts of higher fatty acids, lecithin, poly(vinylpyrrolidone) and copolymers containing half-maleic acid amide component.

The amounts of the main constituting components of the liquid developer of the present invention are further explained below.

The amount of the toner grains consisting essentially of a resin and a colorant is preferably from about 0.5 to about 50 parts by weight per 1000 parts by weight of the liquid carrier. If it is less than about 0.5 part by weight, the image density would be insufficient. However, if it is more than about 50 parts by weight, the non-image area would thereby be fogged. In addition, the above-mentioned liquid carrier-soluble resin for enhancing the dispersion stability may also be used, if desired, and it may be added in an amount of from about 0.5 part by weight to about 100 parts by weight, to 1000 parts by weight of the liquid carrier. The above-mentioned charge-adjusting agent is preferably used in an amount of from about 0.001 to about 1.0 part by weight per 1000 parts by weight of the liquid carrier. In addition, various additives may also be added to the liquid developer of the present invention, if desired, and the upper limit of the total amount of the additives is to be defined in accordance with the electric resistance of the liquid developer. Specifically, if the electric resistance of the liquid developer, from which to toner grains are removed, is lower than $10^9$ Ωcm, images with good continuous gradation could hardly be obtained. Accordingly, the amounts of the respective additives are required to be properly controlled within the above limitation.

Then, the following examples are intended to illustrate the embodiments of this invention in greater detail but not to limit the scope of this invention in any way.

PRODUCTION EXAMPLE I OF DISPERSION-STABILIZING RESIN: PRODUCTION OF DISPERSION-STABILIZING RESIN P-1

A mixture of 97 g of octadecyl methacrylate, 3 g of thioglycolic acid, 5.0 g of divinylbenzene, and 200 g of toluene was heated to 85° C. with stirring under nitrogen gas stream and, after adding thereto 0.8 g of 1,1'-azobis(cyclohexane-1-carbonitrile) (A.C.H.N.), the reaction was carried out for 4 hours. Then, after adding thereto 0.4 g of A.C.H.N., the reaction was carried out for 2 hours and after further adding thereto 0.2 g of A.C.H.N., the reaction was carried out for 2 hours. After cooling, the reaction mixture was reprecipitated in 1.5 liters of methanol and a white powder formed was collected by filtration and dried to provide 88 g of a polymer powder. The weight average molecular weight of the polymer obtained was 30,000.

PRODUCTION EXAMPLES 2 TO 9 OF DISPERSION-STABILIZING RESIN: PRODUCTION OF DISPERSION-STABILIZING RESINS P-2 TO P-9

By following the same procedure as Production Example 1 of dispersion-stabilizing resin except that each of the monomers shown in Table 1 below was used in place of octadecyl methacrylate, each of dispersion-stabilizing resins was produced.

TABLE 1

| Production Example | Dispersion-Stabilizing Resin | Monomer and Amount | | Weight Average Molecular Weight |
|---|---|---|---|---|
| 2 | P-2 | Dodecyl Methacrylate | 97 g | 32,000 |
| 3 | P-3 | Tridecyl Methacrylate | 97 g | 31,000 |
| 4 | P-4 | Octyl Methacrylate | 17 g | 29,000 |
| | | Dodecyl Methacrylate | 80 g | |
| 5 | P-5 | Octadecyl Methacrylate | 70 g | 33,000 |
| | | Butyl Methacrylate | 27 g | |
| 6 | P-6 | Dodecyl Methacrylate | 92 g | 34,000 |
| | | N,N-Dimethyl-aminoethyl Methacrylate | 5 g | |
| 7 | P-7 | Octadecyl Methacrylate | 93 g | 29,000 |
| | | 2-(Trimethoxy-silyloxy)ethyl | 4 g | |

TABLE 1-continued

| Production Example | Dispersion-Stabilizing Resin | Monomer and Amount | | Weight Average Molecular Weight |
|---|---|---|---|---|
| | | Methacrylate | | |
| 8 | P-8 | Hexadecyl Methacrylate | 97 g | 31,000 |
| 9 | P-9 | Tetradecyl Methacrylate | 97 g | 32,000 |

PRODUCTION EXAMPLES 10 TO 22 OF DISPERSION-STABILIZING RESIN: PRODUCTION OF DISPERSION-STABILIZING RESINS P-10 TO P-22

By following the same procedure as Production Example 1 of dispersion-stabilizing resin except that each of the polyfunctional monomers or the oligomers shown in Table 2 below was used in place of 5 g of divinylbenzene as the crosslinking polyfunctional monomer, each of dispersion-stabilizing resins were produced.

TABLE 2

| Production Example | Dispersion-Stabilizing Resin | Crosslinking Monomer or Oligomer | Amount | Weight Average Molecular Weight |
|---|---|---|---|---|
| 10 | P-10 | Ethylene Glycol Dimethacrylate | 4 g | 35,000 |
| 11 | P-11 | Diethylene Glycol Dimethacrylate | 4.5 g | 29,000 |
| 12 | P-12 | Vinyl Methacrylate | 6 g | 40,000 |
| 13 | P-13 | Isopropenyl Methyacrylate | 6 g | 33,000 |
| 14 | P-14 | Divinyl Adipate | 8 g | 32,000 |
| 15 | P-15 | Diallyl Glutaconate | 10 g | 30,000 |
| 16 | P-16 | ISA-22GA (Okamura Seiyu KK.) | 10 g | 45,000 |
| 17 | P-17 | Triethylene Glycol Diacrylate | 2 g | 50,000 |
| 18 | P-18 | Trivinylbenzene | 2 g | 55,000 |
| 19 | P-19 | Polyethylene Glycol #400 Diacrylate | 5 g | 38,000 |
| 20 | P-20 | Polyethylene Glycol Dimethacrylate | 6 g | 40,000 |
| 21 | P-21 | Trimethylolpropane Triacrylate | 1.8 g | 56,000 |
| 22 | P-22 | Polyethylene Glycol #600 Diacrylate | 6 g | 35,000 |

PRODUCTION EXAMPLE 23 OF DISPERSION-STABILIZING RESIN: PRODUCTION OF DISPERSION-STABILIZING RESIN P-23

A mixture of 97 g of octadecyl methacrylate, 3 g of thioglycolic acid, 4.5 g of divinylbenzene, 150 g of toluene, and 50 g of ethanol was heated to 60° C. under nitrogen gas stream and after adding thereto 0.5 g of 2,2'-azobis(isobutyronitrile) (A.I.B.N.), the reaction was carried out for 5 hours. Then, after adding thereto 0.3 g of A.I.B.N., the reaction was carried out for 3 hours and after further adding thereto 0.2 g of A.I.B.N., the reaction was carried out for 3 hours. After cooling, the reaction mixture was re-precipitated in 2 liters of methanol and a white powder formed was collected by filtration and dried to provide 85 g of a polymer powder. The weight average molecular weight of the polymer obtained was 35,000.

PRODUCTION EXAMPLES 24 TO 29 OF DISPERSION-STABILIZING RESIN: PRODUCTION OF DISPERSION-STABILIZING RESINS P-24 TO P-29

By following the same procedure as Production Example 23 of dispersion-stabilizing resin except that each of the mercapto compounds shown in Table 3 below was used in place of 3 g of thiomalic acid, each of dispersion-stabilizing resins was produced.

TABLE 3

| Production Example | Dispersion-Stabilizing Resin | Mercapto Compound | Weight Average Molecular Weight |
|---|---|---|---|
| 24 | P-24 | $HSCH_2CH_2COOH$ | 36,000 |
| 25 | P-25 | 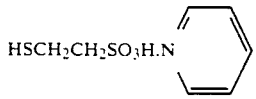 | 29,000 |
| 26 | P-26 | 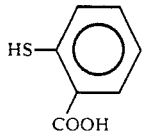 | 38,000 |
| 27 | P-27 | 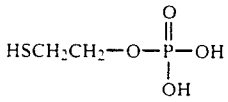 | 33,000 |
| 28 | P-28 | $HSCH_2CH_2NHCO(CH_2)_2COOH$ | 37,000 |
| 29 | P-29 | $HSCH_2CH_2NHCH_2CH_2COOH$ | 35,000 |

PRODUCTION EXAMPLE 30 OF DISPERSION-STABILIZING RESIN: PRODUCTION OF DISPERSION-STABILIZING RESIN P-30

A mixture of 94 g of hexadecyl methacrylate, 1.0 g of diethyl glycol dimethacrylate, 150 g of toluene and 50 g of isopropyl alcohol was heated to 90° C. under a nitrogen gas stream and after adding thereto 6 g of 2,2'-azobis(4-cyanovaleric acid) (A.C.V.), the reaction was carried out for 8 hours. After cooling, the reaction mixture was re-precipitated in 1.5 liters of methanol and a white powder formed was collected by filtration and dried to provide 93 g of a polymer powder. The weight average molecular weight of the polymer obtained was 65,000.

PRODUCTION EXAMPLE 31 OF DISPERSION-STABILIZING RESIN: PRODUCTION OF DISPERSION-STABILIZING RESIN P-31

A mixture of 92 g of docosanyl methacrylate, 1.5 g of ISP-22GA (trade name, made by Okamura Seiyu K.K.), 150 g of toluene, and 50 g of ethanol was heated to 80° C. under nitrogen gas stream and after adding thereto 8 g of 4,4'-azobis(4-cyanopentanol), the reaction was carried out for 8 hours. After cooling, the reaction mixture was re-precipitated in 1.5 liters of methanol and a white powder formed was collected by filtration and dried to provide 78 g of a polymer powder. The weight average molecular weight of the polymer obtained was 41,000.

PRODUCTION EXAMPLE 32 OF DISPERSION-STABILIZING RESIN: PRODUCTION OF DISPERSION-STABILIZING RESIN P-32

A mixture of 95 g of octadecyl methacrylate, 5 g of 2-mercaptoethylamine, 5 g of divinylbenzene, and 200 g of toluene was heated to 85° C. under a nitrogen gas stream and after adding thereto 0.7 g of A.C.H.N., the reaction was carried out for 8 hours.

Then, after adding 8 g of glutaconic acid anhydride and 1 ml of concentrated sulfuric acid to the reaction mixture, the reaction was carried out for 6 hours at 100° C. After cooling, the reaction mixture was re-precipitated in 1.5 liters of methanol and a white powder formed was collected by filtration and dried to provide 93 g of a polymer powder. The weight average molecular weight of the polymer obtained was 31,000.

PRODUCTION EXAMPLE 33 OF DISPERSION-STABILIZING RESIN: PRODUCTION OF DISPERSION-STABILIZING RESIN P-33

A mixture of 95 g of octadecyl methacrylate, 3 g of thioglycolic acid, 6 g of ethylene glycol dimethacrylate, 150 g of toluene, and 50 g of ethanol was heated to 80° C. under a nitrogen gas stream. Then, after adding thereto 2 g of A.C.V., the reaction was carried out for 4 hours and after further adding thereto 0.5 g of A.C.V., the reaction was carried out for 4 hours. After cooling, the reaction mixture was re-precipitated in 1.5 liters of methanol and a white powder formed was collected by filtration and dried to provide 80 g of a polymer powder. The weight average molecular weight of the polymer obtained was 35,000.

PRODUCTION EXAMPLE 34 OF DISPERSION-STABILIZING RESIN: PRODUCTION OF DISPERSION-STABILIZING RESIN P-34

A mixture of 94 g of tridecyl methacrylate, 6 g of 2-mercaptoethanol, 9 g of divinylbenzene, 150 g of toluene, and 50 g of ethanol was heated to 80° C. under a nitrogen gas stream. Then, after adding thereto 4 g of A.C.H.N., the reaction was carried out for 4 hours and after further adding thereto 2 g of A.C.H.N., the reaction was carried out for 4 hours.

After cooling, the reaction mixture was re-precipitated in 1.5 liters of methanol and after removing methanol by decantation, a viscous product thus formed was dried to obtain 75 g of a polymer. The weight average molecular weight of the polymer was 29,000.

PRODUCTION EXAMPLE 35 OF DISPERSION-STABILIZING RESIN: PRODUCTION OF DISPERSION-STABILIZING RESIN P-35

A mixture of 50 g of the aforesaid dispersion-stabilizing resin P-34, 100 g of toluene, 10 g of succinic acid anhydride, and 0.5 g of pyridine was reacted for 10 hours at 90° C. After cooling, the reaction mixture was re-precipitated in 0.8 liter of methanol and after removing methanol by decantation, a viscous product formed was dried to obtain 43 g of a polymer. The weight average molecular weight of the polymer was 30,000.

PRODUCTION EXAMPLES 36 TO 39 OF DISPERSION-STABILIZING RESIN: PRODUCTION OF DISPERSION-STABILIZING RESINS P-36 TO P-39

By following the same procedure as Production Example 35 of dispersion-stabilizing resin except that each of the dicarboxylic acid anhydrides shown in Table 4 below was used in place of succinic anhydride, each of

TABLE 4

| Production Example No. | Dispersion-Stabilizing Resin | Dicarboxylic Acid Anhydride | A-mount (g) | Weight Average Molecular Weight |
|---|---|---|---|---|
| 36 | P-36 | Maleic Anhydride | 8.5 | 30,000 |
| 37 | P-37 | Adipic Anhydride | 11 | " |
| 38 | P-38 | Phthalic Anhydride | 10 | " |
| 39 | P-39 | Tremeritic Anhydride | 12.5 | " |

PRODUCTION EXAMPLE 40 OF DISPERSION-STABILIZING RESIN: PRODUCTION OF DISPERSION-STABILIZING RESIN P-40

A mixture of 86 g of octadecyl methacrylate, 10 g of N-methoxymethylacrylamide, 4 g of thioglycolic acid, 150 g of toluene, and 50 g of isopropanol was heated to 80° C. under a nitrogen gas stream and after adding thereto 0.8 g of A.C.H.N., the reaction was carried out for 8 hours. Then, the reaction mixture was stirred for 6 hours at 110° C. using Dean-Stark to remove isopropanol used as the solvent and methanol by-produced in the reaction.

After cooling, the reaction mixture was re-precipitated in 1.5 liters of methanol and a white powder formed was collected by filtration and dried to provide 82 g of a polymer powder. The weight average molecular weight of the polymer was 45,000.

PRODUCTION EXAMPLE 1 OF OLIGOMER: OLIGOMER B-1

A mixture of 100 g of 2,3 diacetoxypropyl methacrylate, 5 g of 3-mercaptopropionic acid, 150 g of toluene, and 50 g of methanol was heated to 70° C. with stirring under nitrogen gas stream and after adding thereto 1.5 g of 2,2'-azobis(isobutyronitrile) (A.I.B.N.), the reaction was carried out for 4 hours. Then, 0.4 g of A.I.B.N. was added thereto and the reaction was further carried out for 4 hours. After cooling, the reaction mixture was re-precipitated from 2 liters of a methanol/water mixture (4/1 by volume ratio), a methanol solution formed was separated by decantation and the viscous product obtained was dried to obtain 75 g of Oligomer B-1 as a colorless viscous product. The number average molecular weight of the oligomer obtained was 3,300.

Oligomer B-1:

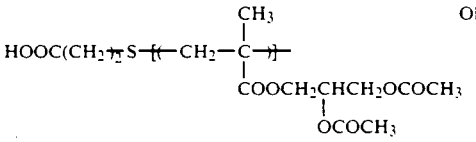

In the above formula as well as the formulae of oligomers described below, the group represented by — — means a recurring unit.

PRODUCTION EXAMPLES 2 TO 13 OF OLIGOMER: OLIGOMERS B-2 TO B-13

By following the same procedure as Production Example 1 of oligomer except that each of the mercapto compounds shown in Table 5 below was used in place of 5 g of 3-mercaptopropionic acid, each of oligomers B-2 to B-13 was produced. The number average molecular weights of the oligomers obtained were from 2,500 to 5,000.

TABLE 5

| Production Example of Oligomer | Oligomer | Mercapto Compound | Amount |
|---|---|---|---|
| II-2 | B-2 | $HOOC-CH_2-SH$ | 5 g |
| II-3 | B-3 | $HOOC-CH(HOOC-CH_2)-SH$ | 4 g |
| II-4 | B-4 | $HOCH_2CH_2SH$ | 3 g |
| II-5 | B-5 | $H_2NCH_2CH_2SH$ | 3 g |
| II-6 | B-6 | 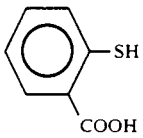 | 5 g |
| II-7 | B-7 | 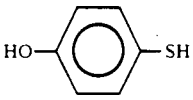 | 4.5 g |
| II-8 | B-8 | $HO-H_2C-HC(OH)-H_2C-SH$ | 3 g |
| II-9 | B-9 | $HO-P(=O)(OH)-OCH_2CH_2-SH$ | 3 g |

TABLE 5-continued

| Production Example of Oligomer | Oligomer | Mercapto Compound | Amount |
|---|---|---|---|
| II-10 | B-10 | 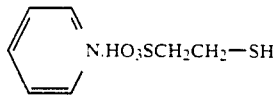 | 4 g |
| II-11 | B-11 | $HOOC(CH_2)_2CONH(CH_2)_2SH$ | 5 g |
| II-12 | B-12 | 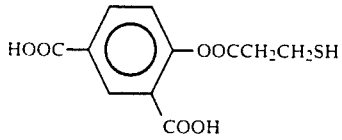 | 5 g |
| II-13 | B-13 | 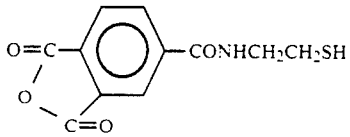 | 6 g |

PRODUCTION EXAMPLES 14 TO 33 OF OLIGOMER: OLIGOMERS B-14 TO B-33

By following the same procedure as Production Example 1 of oligomer except that each of the monomers shown in Table 6 below was used in place of 2,3-diacetoxypropyl methacrylate, each of oligomers B-14 to B-33 was produced. The number average molecular weights of the oligomers obtained were from 2,500 to 3,500.

TABLE 6

$$HOOC\text{-}(CH_2)_2\text{-}S\text{-}(CH_2\text{-}\overset{\overset{CH_3}{|}}{\underset{\underset{COO\text{-}R}{|}}{C}})\text{-}$$

| Production Example of Oligomer | Oligomer | —R |
|---|---|---|
| 14 | B-14 | $\text{-}(CH_2)_2OCOCH_3$ |
| 15 | B-15 | $\text{-}(CH_2)_2OCOC_4H_9$ |
| 16 | B-16 | $\text{-}(CH_2)_2OCOC_9H_{19}$ |
| 17 | B-17 | $\text{-}(CH_2)_2OCO(CH_2)_2COOC_2H_5$ |
| 18 | B-18 | $\text{-}(CH_2)_2OCO(CH_2)_3COOCH_3$ |
| 19 | B-19 | $\text{-}(CH_2)_2OCOCH{=}CH\text{-}COOC_5H_{11}$ |
| 20 | B-20 | $\text{-}CH_2\underset{\underset{OH}{\vert}}{C}HCH_2OOCC_3H_7$ |
| 21 | B-21 | $\text{-}CH_2\underset{\underset{OH}{\vert}}{C}HCH_2OOCC_5H_{11}$ |
| 22 | B-22 | $\text{-}CH_2\underset{\underset{OCOCH_3}{\vert}}{C}HCH_2OCOCH_3$ |
| 23 | B-23 | $\text{-}CH_2\underset{\underset{OCOC_3H_7}{\vert}}{C}HCH_2OCOC_3H_7$ |
| 24 | B-24 | $\text{-}CH_2\underset{\underset{OCOC_5H_{11}}{\vert}}{C}HCH_2OCOC_5H_{11}$ |
| 25 | B-25 | $\text{-}CH_2\underset{\underset{OCOC_6H_{13}}{\vert}}{C}HCH_2OCOC_6H_{13}$ |

TABLE 6-continued $$HOOC\text{-}(CH_2)_2\text{-}S\text{-}(CH_2\text{-}\overset{\overset{CH_3}{|}}{\underset{\underset{COO\text{-}R}{|}}{C}})\text{-}$$

| Production Example of Oligomer | Oligomer | —R |
|---|---|---|
| 26 | B-26 | $\text{-}CH_2\underset{\underset{OCOCH_3}{\vert}}{C}HCH_2OCOC_5H_{11}$ |
| 27 | B-27 | $\text{-}CH_2\underset{\underset{OH}{\vert}}{C}HCH_2OOC(CH_2)_2COOC_3H_7$ |
| 28 | B-28 | $\text{-}CH_2\underset{\underset{OH}{\vert}}{C}HCH_2OOC(CH_2)_3COOCH_3$ |
| 29 | B-29 | $\text{-}CH_2\underset{\underset{OCOCH_3}{\vert}}{C}HCH_2OOC(CH_2)_3COOC_3H_7$ |
| 30 | B-30 | $\text{-}\underset{\underset{COOCH_3}{\vert}}{C}H\text{-}CH_2COOCH_3$ |
| 31 | B-31 | $\text{-}(CH_2)_2OCO(CH_2)_2SO_2C_4H_9$ |
| 32 | B-32 | $\text{-}(CH_2)_2OCO(CH_2)_2SO_2C_8H_{17}$ |
| 33 | B-33 | $\text{-}(CH_2)_6OCOC_2H_5$ |

PRODUCTION EXAMPLE 34 OF OLIGOMER: OLIGOMER B-34

A mixture of 100 g of 2-(n-octylcarbonyloxy)-ethyl crotonate, 150 g of toluene, and 50 g of ethanol was heated to 75° C. with stirring under nitrogen gas stream and, after adding thereto 8 g of 2,2'-azobis(cyanovaleric acid) (A.C.V.), the reaction was carried out for 5 hours. Then, 2 g of A.C.V. was added thereto and the reaction was further carried out for 4 hours. After cooling, the reaction mixture obtained was reprecipitated in 2 liters of a methanol/water mixture (4/1 by volume ratio), the methanol solution formed was separated by decantation, and the viscous product formed was dried to obtain 70 g of Oligomer B-34 shown below. The number average molecular weight of the oligomer obtained was 2,600.

Oligomer B-34:

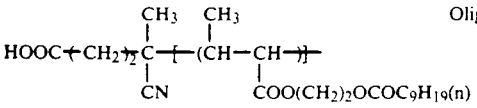

PRODUCTION EXAMPLE 35 TO 43 OF OLIGOMER: OLIGOMERS B-35 TO B-43

By following the same procedure as Production Example 34 of oligomer except that each of the azobis compounds shown in Table 7 below was used in place of the polymerization initiator, A.C.V., each of the oligomers B-35 to B-43 was produced. The number average molecular weights of the oligomers obtained were from 2,000 to 4,000.

TABLE 7

| Production Example of Oligomer | Oligomer | R—N=N—R: Azobis Compound<br>Azobis Compound: R— |
|---|---|---|
| 35 | B-35 | 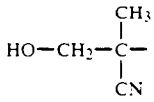 |
| 36 | B-36 | 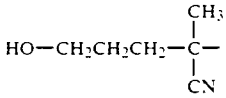 |
| 37 | B-37 | 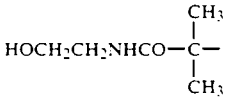 |
| 38 | B-38 | 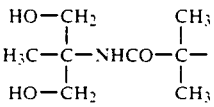 |
| 39 | B-39 | 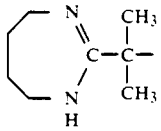 |
| 40 | B-40 | 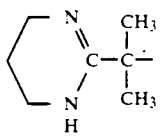 |
| 41 | B-41 | 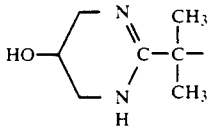 |
| 42 | B-42 | 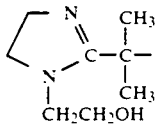 |
| 43 | B-43 | 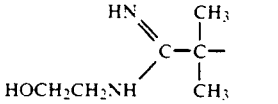 |

PRODUCTION EXAMPLE 44 OF OLIGOMER: OLIGOMER B-44

A mixture of 100 g of methyl methacrylate, 5 g of thioglycolic acid, 150 g of toluene, and 50 g of methanol was heated to 70° C. with stirring under nitrogen gas stream and, after adding thereto 1.5 g of 2,2'-azobis-(isobutyronitrile) (A.I.B.N.), the reaction was carried out for 4 hours. Then, 0.4 g of A.I.B.N. was added thereto and the reaction was further carried out for 4 hours.

After cooling, the reaction mixture thus obtained was re-precipitated from 2 liters of a methanol/ water mixture (4/1 by volume ratio), a methanol solution formed was separated by decantation, and a viscous product obtained was dried to obtain 75 g of a colorless viscous product. The number average molecular weight of the oligomer thus obtained was 2,800.

PRODUCTION EXAMPLES 45 TO 55 OF OLIGOMER: OLIGOMERS B-45 TO B-55

By following the same procedure as Production Example 44 of oligomer except that each of the mercapto compounds shown in Table 8 below was used in place of 5 g of thioglycolic acid, each of oligomers B-45 to B-55 was produced. The number average molecular weights of the oligomers obtained were from 2,500 to 3,500.

TABLE 8

| Production Example of Oligomer | Oligomer | Mercapto Compound | Amount |
|---|---|---|---|
| 45 | B-45 | $HOOC-CH_2CH_2SH$ | 5 g |
| 46 | B-46 | $HOOC-CH(HOOC-CH_2)-SH$ | 4 g |
| 47 | B-47 | $HOCH_2CH_2SH$ | 3 g |
| 48 | B-48 | $H_2NCH_2CH_2SH$ | 3 g |
| 49 | B-49 | 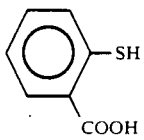 | 5 g |
| 50 | B-50 | 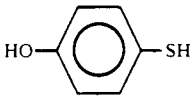 | 4.5 g |
| 51 | B-51 | $HO-H_2C-HC(OH)-H_2C-SH$ | 3 g |

TABLE 8-continued

| Production Example of Oligomer | Oligomer | Mercapto Compound | Amount |
|---|---|---|---|
| 52 | B-52 | $HO-\overset{\overset{O}{\|}}{\underset{\underset{OH}{\|}}{P}}-OCH_2CH_2-SH$ | 3 g |
| 53 | B-53 | 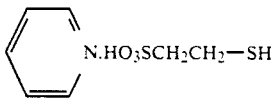 | 4 g |
| 54 | B-54 | $HOOC(CH_2)_2CONH(CH_2)_2SH$ | 5 g |
| 55 | B-55 | 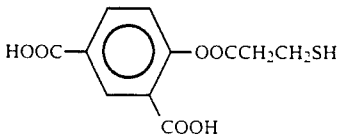 | 5 g |

PRODUCTION EXAMPLE 56 TO 66 OF OLIGOMER: OLIGOMERS B-56 TO B-66

By following the same procedure as Production Example 44 of oligomer except that each of the monomers shown in Table 9 below was used in place of methyl methacrylate, each of oligomers B-56 to B-66 was produced. The number average molecular weights of the oligomers obtained were from 2,500 to 3,500.

TABLE 9

| Production Example of Oligomer | Oligomer | Monomer & Amount of Monomer | |
|---|---|---|---|
| 56 | B-56 | Ethyl Methacrylate | 100 g |
| 57 | B-57 | Propyl Methacrylate | 100 g |
| 58 | B 58 | Butyl Methacrylate | 100 g |
| 59 | B-59 | Hexyl Methacrylate | 100 g |
| 60 | B-60 | 2-Ethylhexyl Methacrylate | 100 g |
| 61 | B-61 | Dodecyl Methacrylate | 100 g |
| 62 | B-62 | Tridecyl Methacrylate | 100 g |
| 63 | B-63 | Octadecyl Methacrylate | 100 g |
| 64 | B-64 | Octadecyl Methacrylate | 50 g |
| | | Butyl Methacrylate | 50 g |
| 65 | B-65 | Butyl Methacrylate | 90 g |
| | | Styrene | 10 g |
| 66 | B-66 | Decyl Methacrylate | 95 g |
| | | N,N-Diethylaminoethyl Methacrylate | 5 g |

PRODUCTION EXAMPLE 67 OF OLIGOMER: OLIGOMER B-67

A mixture of 100 g of methyl methacrylate, 150 g of toluene, and 50 g of ethanol was heated to 75° C. with stirring under nitrogen gas stream and after adding thereto 8 g of 2,2'-azobis(cyanovaleric acid) (A.C.V.), the reaction was carried out for 4 hours. Then, 2 g of A.C.V. was added thereto and the reaction was further carried out for 4 hours. After cooling, the reaction mixture obtained was re-precipitated in 2 liters of a methanol/water mixture (4/1 by volume ratio), a methanol solution formed was separated by decantation, a viscous product obtained was dried to obtain 70 g of a polymer. The number average molecular weight of the oligomer obtained was 2,600.

PRODUCTION EXAMPLES 68 TO 76 OF OLIGOMER: OLIGOMERS B-68 TO B-76

By following the same procedure as Production Example 67 except that each of the azobis compounds shown in Table 10 below was used in place of the polymerization initiator, A.C.V., each of oligomers B-68 to B-76 was produced. The number average molecular weights of the oligomers obtained were from 2,000 to 4,000.

TABLE 10

| Production Example of Oligomer | Oligomer | R—N=N—R: Azobis Compound Azobis Compound: R— |
|---|---|---|
| 68 | B-68 | $HO-CH_2-\overset{\overset{CH_3}{\|}}{\underset{\underset{CN}{\|}}{C}}-$ |
| 69 | B-69 | $HO-CH_2CH_2CH_2-\overset{\overset{CH_3}{\|}}{\underset{\underset{CN}{\|}}{C}}-$ |
| 70 | B-70 | $HOCH_2CH_2NHCO-\overset{\overset{CH_3}{\|}}{\underset{\underset{CH_3}{\|}}{C}}-$ |
| 71 | B-71 | $\underset{\underset{HO-CH_2}{\|}}{\overset{\overset{HO-CH_2}{\|}}{H_3C-C}}-NHCO-\overset{\overset{CH_3}{\|}}{\underset{\underset{CH_3}{\|}}{C}}-$ |
| 72 | B-72 | 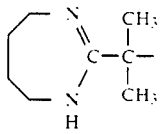 |
| 73 | B-73 | 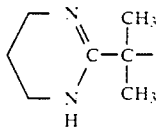 |
| 74 | B-74 | 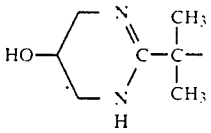 |
| 75 | B-75 | 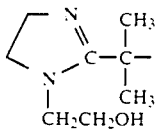 |
| 76 | B-76 | 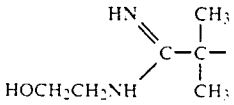 |

PRODUCTION EXAMPLE 1 OF LATEX GRAINS: LATEX D-1

A mixture of 20 g of the dispersion-stabilizing resin P-1, 100 g of vinyl acetate, 1.0 of the oligomer B-44, and 380 g of Isopar H was heated to 70° C. under nitrogen gas stream and, after adding thereto 0.8 g of 2,2'-azobis(-valeronitrile) (A.B.V.N.), the reaction was carried out for 6 hours. Twenty minutes after the addition of the polymerization initiator, the reaction mixture became white-turbid and the reaction temperature raised to 88° C. Then, the temperature of the system was raised to 100° C. and the reaction mixture was stirred for 2 hours to distil off unreacted vinyl acetate. After cooling, the reaction mixture was passed through a 200 mesh nylon cloth to provide a latex having a mean grain size of 0.24 μm with a polymerization ratio of 88% as a white dispersion.

PRODUCTION EXAMPLES 2 TO 21 OF LATEX GRAINS: LATEXES D-2 TO D-21

By following the same procedure as Production Example 1 of latex grains except that each of the oligomers shown in Table 11 below was used in place of the oligomer B-44, each of white dispersions (latexes) was obtained. The polymerization ratios of the white dispersions were from 85% to 90%. Also, the mean grain sizes of the latexes obtained were from 0.23 μm to 0.27 μm.

TABLE 11

| Production Example of Latex | Latex | Oligomer |
|---|---|---|
| 2 | D-2 | B-45 |
| 3 | D-3 | B-46 |
| 4 | D-4 | B-47 |
| 5 | D-5 | B-48 |
| 6 | D-6 | B-49 |
| 7 | D-7 | B-50 |
| 8 | D-8 | B-51 |
| 9 | D-9 | B-52 |
| 10 | D-10 | B-53 |
| 11 | D-11 | B-54 |
| 12 | D-12 | B-55 |
| 13 | D-13 | B-56 |
| 14 | D-14 | B-57 |
| 15 | D-15 | B-59 |
| 16 | D-16 | B-60 |
| 17 | D-17 | B-61 |
| 18 | D-18 | B-63 |
| 19 | D-19 | B-64 |
| 20 | D-20 | B-66 |
| 21 | D-21 | B-67 |

PRODUCTION EXAMPLES 22 TO 35 OF LATEX GRAINS: LATEXES D-22 TO D-35

By following the same procedure as Production Example 1 of latex grains except that each of the dispersion stabilizing resins and each of the oligomers described in Table 8 below were used in place of the dispersion stabilizing resin P-1 and the oligomer B-44, each of white dispersions was obtained. The polymerization ratios of the dispersions obtained were from 85% to 90%.

TABLE 12

| Production Example of Latex | Latex | Dispersion Stabilizing Resin and Amount | | Oligomer and Amount | | Average Grain Size of Latex (μm) |
|---|---|---|---|---|---|---|
| 22 | D-22 | P-2 | 18 g | B-44 | 1.0 g | 0.24 |
| 23 | D-23 | P-3 | 19 g | B-44 | 1.0 g | 0.24 |
| 24 | D-24 | P-5 | 20 g | B-44 | 1.0 g | 0.26 |
| 25 | D-25 | P-8 | 20 g | B-44 | 1.0 g | 0.28 |
| 26 | D-26 | P-9 | 20 g | B-64 | 1.0 g | 0.26 |
| 27 | D-27 | P-10 | 18 g | B-66 | 1.0 g | 0.23 |

TABLE 12-continued

| Production Example of Latex | Latex | Dispersion Stabilizing Resin and Amount | | Oligomer and Amount | | Average Grain Size of Latex (μm) |
|---|---|---|---|---|---|---|
| 28 | D-28 | P-11 | 16 g | B-51 | 1.2 g | 0.23 |
| 29 | D-29 | P-23 | 16 g | B-45 | 0.8 g | 0.24 |
| 30 | D-30 | P-20 | 15 g | B-68 | 0.8 g | 0.27 |
| 31 | D-31 | P-24 | 16 g | B-69 | 0.9 g | 0.25 |
| 32 | D-32 | P-25 | | B-70 | 1.0 g | 0.27 |
| 33 | D-33 | P-27 | | B-71 | 0.6 g | 0.24 |
| 34 | D-34 | P-28 | | B-73 | 0.5 g | 0.25 |
| 35 | D-35 | P-40 | | B-44 | 0.5 g | 0.26 |

PRODUCTION EXAMPLE 36 OF LATEX GRAINS; LATEX D-36

A mixture of 20 g of the dispersion-stabilizing resin P-30, 100 g of vinyl acetate, 5 g of crotonic acid, 1.0 g of the oligomer B-46, and 468 g of Isopar E was heated to 70° C. with stirring under nitrogen gas stream and after adding thereto 0.7 g of A.B.V.N., the reaction was carried out for 6 hours. Thereafter, the temperature of the system was raised to 100° C. and the reaction mixture was stirred for one hour at the temperature to distil off remaining vinyl acetate. After cooling, the reaction mixture obtained was passed through a 200 mesh nylon cloth to provide a latex having a mean grain size of 0.23 μm with a polymerization ratio of 85% as a white dispersion.

PRODUCTION EXAMPLE 37 OF LATEX GRAINS: LATEX D-37

A mixture of 20 g of the dispersion-stabilizing resin P-32, 100 g of vinyl acetate, 6.0 g of 4-pentenic acid, 0.8 g of the oligomer B-58, and 380 g of Isopar G was heated to 70° C. with stirring under nitrogen gas stream and after adding thereto 0.7 g of benzoyl peroxide, the reaction was carried out for 4 hours. Then, 0.5 g of benzoyl peroxide was added thereto and the reaction was further carried out for 2 hours. After cooling, the reaction mixture obtained was passed through a 200 mesh nylon to provide a latex having a mean grain size of 0.24 μm as a white dispersion.

PRODUCTION EXAMPLE 38 OF LATEX GRAINS: LATEX D-38

A mixture of 18 g of the dispersion-stabilizing resin P-34, 85 g of vinyl acetate, 15 g of N-vinylpyrrolidone, 1.2 g of the oligomer B-52, and 380 g of n-decane was heated to 75° C. with stirring under nitrogen gas stream and after adding thereto 7 g of A.I.B.N., the reaction was carried out for 4 hours. Then, 0.5 g of A.I.B.N. was added thereto and the reaction was further carried out for 2 hours. After cooling, the reaction mixture obtained was passed through a 200 mesh nylon cloth to provide a latex having a mean grain size of 0.20 μm as a white dispersion.

PRODUCTION EXAMPLE 39 OF LATEX GRAINS: LATEX D-39

A mixture of 20 g of the dispersion-stabilizing resin P-30, 100 g of methyl methacrylate, 1.0 g of the oligomer B-62, and 470 g of n-decane was heated to 70° C. with stirring under nitrogen gas stream and after adding 1.0 g of A.I.B.N., the reaction was carried out for 2 hours. Few minutes after the addition of the polymerization initiator, the reaction mixture began to become blue-white turbid and the reaction temperature raised to 90° C. After cooling, the reaction mixture was passed through a 200 mesh nylon cloth to remove coarse grains, thereby a latex having a mean grain size of 0.45 μm was obtained as a white dispersion.

PRODUCTION EXAMPLE 40 OF LATEX GRAINS: (COMPARISON EXAMPLE A)

By following the same procedure as Production Example 1 of latex grains except that the oligomer B-44 was not used, a latex having a mean grain size of 0.25 μm with a polymerization ratio of 85% was obtained as a white dispersion.

PRODUCTION EXAMPLE 41 OF LATEX GRAINS: (COMPARISON EXAMPLE B)

By following the same procedure as Production Example 1 of latex grains except that a mixture of 18 g of poly(octadecyl methacrylate), 100 g of vinyl acetate, 1.0 g of octadecyl methacrylate, and 385 g of Isopar H was used, a latex having a mean grain size of 0.22 μm with a polymerization ratio of 85% was obtained as a white dispersion.

PRODUCTION EXAMPLE 42 OF LATEX GRAINS: (COMPARISON EXAMPLE C)

By following the same procedure as Production Example 1 of latex grains except that a mixture of 18 g of poly(octadecyl methacrylate), 100 g of vinyl acetate, 1 g of a monomer (I) having the following chemical structure, and 385 g of Isopar H was used, a latex having a mean grain size of 0.24 μm with a polymerization ratio of 86% was obtained as a white dispersion.

Monomer (I):

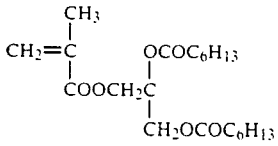

PRODUCTION EXAMPLE 43 OF LATEX GRAINS: LATEX D-43

A mixture of 20 g of the dispersion-stabilizing resin P-1, 100 g of vinyl acetate, 1.0 g of the oligomer B-1, and 380 g of Isopar H was heated to 70° C. with stirring under nitrogen gas stream and after adding thereto 0.8 q of 2,2'-azobis(isovaleronitrile) (A.I.V.N.), the reaction was carried out for 2 hours. Then, 0.3 g of A.I.V.N. was added thereto and the reaction was further carried out for 2 hours. Twenty minutes after the addition of the polymerization initiator, the reaction mixture became white turbid and the reaction temperature raised to 88° C. The temperature of the system was raised to 100° C. and the reaction mixture was stirred to distil off unreacted vinyl acetate. After cooling, the reaction mixture was passed through a 200 mesh nylon cloth to obtain a latex having a mean grain size of 0.23 μm with a polymerization ratio of 89% as a white dispersion.

PRODUCTION EXAMPLES 44 TO 72 OF LATEX GRAINS: LATEXES D-44 TO D-72

By following the same procedure as Production Example 43 of latex grains except that each of the dispersion stabilizing resins and each of the oligomers shown in Table 13 below were used in the dispersion stabilizing resin and the oligomer in the example, each of latex grains was produced. The polymerization ratios of the latex grains thus obtained were from 85% to 90%.

TABLE 13

| Production Example of Latex | Latex | Dispersion Stabilizing Resin and Amount | | Oligomer and Amount | | Average Grain Size of Latex |
|---|---|---|---|---|---|---|
| 44 | D-44 | P-2 | 16 g | B-1 | 1.0 g | 0.22 μm |
| 45 | D-45 | P-3 | 16 g | B-2 | 1.0 g | 0.23 μm |
| 46 | D-46 | P-4 | 17 g | B-3 | 0.8 g | 0.24 μm |
| 47 | D-47 | P-5 | 16 g | B-4 | 1.0 g | 0.20 μm |
| 48 | D-48 | P-8 | 18 g | B-17 | 1.0 g | 0.22 μm |
| 49 | D-49 | P-9 | 17 g | B-19 | 0.8 g | 0.21 μm |
| 50 | D-50 | P-10 | 18 g | B-21 | 0.6 g | 0.23 μm |
| 51 | D-51 | P-11 | 18 g | B-22 | 1.0 g | 0.23 μm |
| 52 | D-52 | P-12 | 17 g | B-25 | 2.0 g | 0.22 μm |
| 53 | D-53 | P-13 | 16 g | B-30 | 1.0 g | 0.20 μm |
| 54 | D-54 | P-14 | 18 g | B-26 | 0.8 g | 0.22 μm |
| 55 | D-55 | P-16 | 20 g | B-34 | 1.0 g | 0.18 μm |
| 56 | D-56 | P-18 | 16 g | B-35 | 1.2 g | 0.23 μm |
| 57 | D-57 | P-19 | 17 g | B-36 | 1.0 g | 0.22 μm |
| 58 | D-58 | P-20 | 16 g | B-38 | 1.5 g | 0.24 μm |
| 59 | D-59 | P-22 | 17 g | B-39 | 0.7 g | 0.21 μm |
| 60 | D-60 | P-23 | 18 g | B-34 | 1.2 g | 0.22 μm |
| 61 | D-61 | P-24 | 18 g | B-41 | 1.3 g | 0.22 μm |
| 62 | D-62 | P-25 | 16 g | B-24 | 1.3 g | 0.24 μm |
| 63 | D-63 | P-26 | 18 g | B-9 | 1.5 g | 0.22 μm |
| 64 | D-64 | P-27 | 16 g | B-14 | 0.8 g | 0.22 μm |
| 65 | D-65 | P-28 | 17 g | B-18 | 1.0 g | 0.23 μm |
| 66 | D-66 | P-32 | 16 g | B-29 | 1.5 g | 0.20 μm |
| 67 | D-67 | P-34 | 16 g | B-10 | 0.5 g | 0.21 μm |
| 68 | D-68 | P-37 | 18 g | B-10 | 0.8 g | 0.23 μm |
| 69 | D-69 | P-40 | 20 g | B-13 | 1.0 g | 0.18 μm |
| 70 | D-70 | P-30 | 16 g | B-5 | 1.4 g | 0.20 μm |
| 71 | D-71 | P-31 | 20 g | B-6 | 2.0 g | 0.24 μm |
| 72 | D-72 | P-33 | 18 g | B-22 | 0.8 g | 0.20 μm |

PRODUCTION EXAMPLE 73 OF LATEX GRAINS: LATEX D-73

A mixture of 16 g of the dispersion-stabilizing resin P-7, 100 g of vinyl acetate, 5 g of crotonic acid, 1.5 g of the oligomer B-36, and 468 g of Isopar E was heated to 70° C. with stirring under nitrogen gas stream and after adding thereto 1.3 g of A.I.V.N., the reaction was carried out for 6 hours. Then, the temperature of the system was raised to 100° C. and the reaction mixture was stirred at the temperature for one hour to distil off remaining vinyl acetate. After cooling, the reaction mixture was passed through a 200 mesh nylon cloth to provide a latex having a mean grain size of 0.22 μm with a polymerization ratio of 85% as a white dispersion.

PRODUCTION EXAMPLE 74 OF LATEX GRAINS: LATEX D-74

A mixture of 18 g of the dispersion-stabilizing resin P-27, 100 g of vinyl acetate, 6.0 g of 4-pentenic acid, 0.8 g of the oligomer B-22, and 380 g of Isopar G was heated to 75° C. with stirring under nitrogen gas stream and after adding thereto 0.7 g of A.I.B.N., the reaction was carried out for 4 hours. Then, 0.5 g of A.I.B.N was added thereto and the reaction was further carried out for 2 hours. After cooling, the reaction mixture was passed through a 200 mesh nylon cloth to obtain a latex having a mean grain size of 0.23 μm and a polymerization ratio of 89% as a white dispersion.

PRODUCTION EXAMPLE 75 OF LATEX GRAINS: LATEX D-75

A mixture of 18 g of the dispersion-stabilizing resin P-32, 85 g of vinyl acetate, 15 g of N-vinylpyrrolidone, 0.6 g of the oligomer B-1, and 380 g of n-decane was heated to 75° C. with stirring under nitrogen gas stream and after adding thereto 1.7 g of A.I.B.N., the reaction was carried out for 4 hours. Then, 0.5 g of A.I.B.N. was added thereto and the reaction was further carried out for 2 hours. After cooling, the reaction mixture was passed through a 200 mesh nylon cloth to provide a latex having a mean grain size of 0.20 μm and a polymerization ratio of 88% as a white dispersion.

PRODUCTION EXAMPLE 76 OF LATEX GRAINS: LATEX D-76

A mixture of 20 g of the dispersion-stabilizing resin P-1, 100 g of isopropyl methacrylate, 0.8 g of the oligomer B-23, and 470 g of n-decane was heated to 70° C. with stirring under nitrogen gas stream and after adding thereto 1.0 g of A.I.V.N., the reaction was carried out for 2 hours. After few minutes since the addition of the polymerization initiator, the reaction mixture became blue-white turbid and the reaction temperature raised to 90° C. After cooling, the reaction mixture was passed through a 200 mesh nylon cloth to remove coarse grains, thereby a latex having a mean grain size of 0.25 μm and a polymerization ratio of 85% was obtained as a white dispersion.

PRODUCTION EXAMPLE 77 OF LATEX GRAINS: LATEX D-77

A mixture of 16 g of the dispersion-stabilizing resin P-2, 100 g of styrene, 0.9 g of the oligomer B-6, and 380 g of Isopar H was heated to 60° C. with stirring under nitrogen gas stream and after adding thereto 0.6 g of A.I.V.N., the reaction was carried out for 4 hours. Then, 0.3 g of A.I.V.N. was added thereto and the reaction was further carried out for 3 hours. After cooling, the reaction mixture was passed through a 200 mesh nylon cloth to provide a latex having a mean grain size of 0.23 μm and a polymerization ratio of 84% as a white dispersion.

PRODUCTION EXAMPLE 78 OF LATEX GRAINS; (COMPARISON EXAMPLE A-1)

By following the same procedure as Production Example 43 of latex grains except that the oligomer B-1 was not used, a latex having a mean grain size of 0.25 μm with a polymerization ratio of 85% was obtained as a white dispersion. PRODUCTION EXAMPLE 79 OF LATEX GRAINS: (COMPARISON EXAMPLE B-1)

By following the same procedure as Production Example 43 of latex grains except that a mixture of 18 g of poly(octadecyl methacrylate), 100 g of vinyl acetate, 1.0 g of octadecyl methacrylate, and 385 g of Isopar H was used, a latex having a mean grain size of 0.22 μm with a polymerization ratio of 85% was obtained as a white dispersion. (The product corresponds to the latex of JP-A-60-179751).

PRODUCTION EXAMPLE 80 OF LATEX GRAINS: (COMPARISON EXAMPLE C-1)

By following the same procedure as Production Example 43 of latex grains except that a mixture of 18 g of poly(octadecyl methacrylate), 100 g of vinyl acetate, 1 g of a monomer (I) having the following chemical structure, and 385 g of Isopar H was used, a latex having a mean grain size of 0.24 μm with a polymerization ratio of 86% was obtained as a white dispersion. (The product corresponds to the latex of JP-A-62-151868).

Monomer (I):

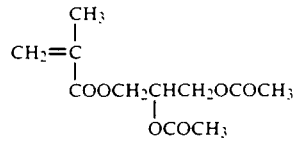

EXAMPLE 1

In a paint shaker (manufactured by Tokyo Seiki K.K.) were placed 10 g a dodecyl methacrylate/acrylic acid copolymer (95/5 by weight ratio), 10 g of nigrosine and 30 g of Shellsol 71 together with glass beads and they were dispersed for 4 hours to provide a fine dispersion of nigrosine.

Then, a liquid developer for electrostatic photography was prepared by diluting 30 g of resin dispersion D-1 obtained in Production Example 1 of latex grains, 2.5 g of the aforesaid nigrosine dispersion, 15 g of FOC-1400 (trade name, made by Nissan Chemical Industries, Ltd., tetradecyl alcohol), and 0.08 g of a copolymer of octadecene and semi-maleic octadecylamide with one liter of Shellsol 71.

Comparison Liquid Developer 1-A, 1-B, and 1-C

Three kinds of comparison liquid developers 1-A, 1-B, and 1-C were prepared in the same manner as above except that the latexes shown below were used in place of the resin dispersion used above

Comparison Liquid Developer 1-A

The resin dispersion obtained in Production Example 78 of latex grains was used.

Comparison Liquid Developer 1-B

The resin dispersion obtained in Production Example 79 of latex grains was used.

Comparison Liquid Developer 1-C

The resin dispersion obtained in Production Example 80 of latex grains was used.

An electrophotographic light-sensitive material, ELP Master II Type (trade name, made by Fuji Photo Film Co., Ltd.) was image-exposed and developed by a full-automatic processor, ELP 404V (trade name, made by Fuji Photo Film Co., Ltd.) using each of the liquid developers thus prepared. The processing (plate-making) speed was 5 plates/minute Furthermore, after processing 2,000 plates of ELP Master II Type, the occurrence of stains of the developing apparatus by sticking of the toner was observed. The blackened ratio (imaged area) of the duplicated images was determined using 30% original. The results obtained are shown in Table 14 below.

TABLE 14

| Test No. | Liquid Developer | Stains of Developing Apparatus | Image of the 2,000th Plate |
|---|---|---|---|
| 1 | Developer of Example 1 | No toner residue adhered | Clear |
| 2 | Developer 1-A | Toner residue greatly adhered | Letter part lost, density of solid black lowered, background portion fogged |
| 3 | Developer 1-B | Toner residue adhered | Density of fine lines slightly lowered, Dmax lowered |

TABLE 14-continued

| Test No. | Liquid Developer | Stains of Developing Apparatus | Image of the 2,000th Plate |
|---|---|---|---|
| 4 | Developer 1-C | Toner residue adhered | Density of fine lines slightly lowered, Dmax lowered |

As is clear from the results shown above, when printing plates were produced by the aforesaid processing condition using each liquid developer, the liquid developer of this invention only caused no stains of the developing apparatus and gave clear images of the 2,000th plate.

Then, the offset printing master plate (ELP Master) prepared by processing using each of the liquid developers was used for printing in a conventional manner, and the number of prints obtained before occurrences of defects of letters on the images of the print, the lowering of the density of the solid black portions of the image, etc., was checked. The results showed that the master plate obtained by using each of the liquid developer of this invention and the liquid developers of Comparison Examples A-1 and C-1 gave more than 10,000 prints without accompanied by the aforesaid failures, while the master plate prepared using the developer of Comparison Example B-1 resulted in the failures after 8,000 prints.

As is clear from the aforesaid results, only the liquid developer of this invention could advantageously be used for preparing a large number of prints by the master plate without causing stains of the developing apparatus.

In the case of using Comparison Liquid Developer A, there was no problem on the number of prints but the developing apparatus was too stained to further use continuously.

Also, in the cases of Comparison Liquid Developers 1-B and 1-C, the developing apparatus was stained (in particular, on the back surface of the electrode plate) when the developer was used under the condition of a rapid processing speed as 5 plates/minute (an ordinary processing speed was 2 or 3 plates/minute) and after the formation of about 2,000 plates, the image quality of the duplicated images of the plate was reduced (the reduction of Dmax, lowering of the density of fine lines, etc.) There was no problem on the number of prints by the master plate in the case of using the Comparison Liquid Developer 1-C but the number thereof was lowered in the case of using the Comparison Liquid Developer 1-B.

These results show that the resin grains of this invention are clearly excellent.

EXAMPLE 2

A mixture of 100 g of the white dispersion (latex grains) obtained in Production Example 2 of latex grains and 1.5 g of Sumikalon Black was heated to 100° C with stirring for 4 hours. After cooling to room temperature, the reaction mixture was passed through a 200 mesh nylon cloth to remove the remaining dye, whereby a black resin dispersion having a mean grain size of 0.23 μm was obtained.

A liquid developer was prepared by diluting 32 g of the aforesaid black resin dispersion, 0.05 g of zirconium naphthenate, and 20 g of a higher alcohol, FOC-1600 (trade name, made by Nissan Chemical Industries, Ltd.), with one liter of Shellsol 71.

When the liquid developer was applied to the same developing apparatus as in Example 1, no occurrence of stains of the developing apparatus by sticking of the toner was observed even after developing 2,000 plates.

Also, the quality of the offset printing master plate obtained was clear and also the image quality of the 10,000 print formed using the maser plate was very clear.

EXAMPLE 3

A mixture of 100 g of the white dispersion obtained in Production Example 74 of latex grains and 3 g of Victoria Blue B was heated to a temperature of from 70° C. to 80° C. with stirring for 6 hours. After cooling to room temperature, the reaction mixture was passed through a 200 mesh nylon cloth to remove the remaining dye, whereby a blue resin dispersion having a mean grain size of 0.25 μm was obtained.

A liquid developer was prepared by diluting 32 g of the aforesaid blue resin dispersion and 0.05 g of zirconium naphthenate with one liter of Isopar H.

When the liquid developer was applied to the same developing apparatus as in Example 1, no occurrence of stains of the developing apparatus by sticking of the toner was observed even after developing 2,000 plates. Also, the image quality of the offset printing master plate obtained was clear and also the image quality of the 10,000th print was very clear.

EXAMPLE 4

A liquid developer was prepared by diluting 32 g of the white resin dispersion obtained in Production Example 45 of latex grains, 2.5 g of the nigrosine dispersion obtained in Example 1, 15 g of FOC-1800 (trade name, made by Nissan Chemical Industries, Ltd., octadecyl alcohol), and 0.02 g of a semi-docosanylamidated product of a copolymer of diisobutyrene and maleic anhydride with one liter of Isopar G.

When the liquid developer was applied to the same developing apparatus as in Example 1, no occurrence of stains of the developing apparatus by sticking of the toner was observed even after developing 2,000 plates. Also, the image quality of the offset printing master plate obtained and the image quality of the 10,000th print obtained using the master plate were very clear.

Furthermore, when the same processing as above was applied after allowing to stand the liquid developer for 3 months, the results were same as above.

EXAMPLE 5

In a paint shaker were placed 10 g of poly(decyl methacrylate), 30 g of Isopar H, and 8 g of Alkali Blue together with glass beads followed by dispersing for 2 hours to provide a fine dispersion of Alkali Blue.

A liquid developer was prepared by diluting 30 g of the white resin dispersion D-65 obtained in Production Example 65 of latex grains, 4.2 g of the aforesaid Alkali Blue dispersion, and 0.06 g of a semidocosanylaminated product of a copolymer of octadecyl vinyl ether and maleic anhydride, with one liter of Isopar G.

When the liquid developer was applied to the same developing apparatus as in Example 1, no occurrence of stains of the developing apparatus by sticking of the toner was observed even after developing 2000 plates. Also, the image quality of the offset printing master plate obtained and the image quality of the 10,000th print obtained using the master plate were very clear.

EXAMPLE 6 TO 27

By following the same procedure as Example 5 except that each of the latex resin of this invention shown in Table 15 below was used in place of the resin dispersion D-65, each of liquid developers was prepared.

TABLE 15

| Example | Latex Grains | Example | Latex Grains |
|---|---|---|---|
| 6 | D-43 | 17 | D-57 |
| 7 | D-44 | 18 | D-58 |
| 8 | D-46 | 19 | D-59 |
| 9 | D-47 | 20 | D-60 |
| 10 | D-48 | 21 | D-63 |
| 11 | D 49 | 22 | D-64 |
| 12 | D-50 | 23 | D-66 |
| 13 | D-51 | 24 | D-67 |
| 14 | D-52 | 25 | D-71 |
| 15 | D-53 | 26 | D-72 |
| 16 | D-54 | 27 | D-73 |

When each of the liquid developers was applied to the same developing apparatus as in Example 1, no occurrence of stains of the developing apparatus by sticking of the toner was observed even after developing 2,000 plates. Also, the image quality of the offset printing masters obtained and the image quality of the 10,000th print obtained using each of the master plates were very clear.

Furthermore, when the aforesaid processing was repeated after allowing each of the liquid developers to stand for 3 months, the results obtained were found to be the same as above.

EXAMPLE 28

In a paint shaker (manufactured by Tokyo Seiki K.K.) were placed 10 g of a dodecyl methacrylate/acrylic acid copolymer (95/5 by weight ratio), 10 g of nigrosine and 30 g of Shellsol 71 together with glass beads followed by dispersing for 4 hours to provide a fine dispersion of nigrosine.

A liquid developer was prepared by diluting 30 g of the latex grains D-1 obtained in Production Example 1 of latex grains, 2.5 g of the aforesaid nigrosine dispersion, and 0.08 g of a copolymer of octadecene and semi-maleic octadecylamide, with one liter or Shellsol 71.

Comparison Liquid Developers 2-A, 2-B, and 2-C:

Three kinds of comparison liquid developers 2-A, 2-B, and 2-C wee prepared using the following latex grains in place of latex grains D-1 in the above-described production method.

Comparison Liquid Developer 2-A:

The resin dispersion obtained in Production Example 40 of latex grains was used.

Comparison Liquid Developer 2-B:

The resin dispersion obtained in Production Example 41 of latex grains was used.

Comparison Liquid Developer 2-C:

The resin dispersion obtained in Production Example 42 of latex grains was used.

An electrophotographic light-sensitive material, ELP Master II Type (trade name, made by Fuji Photo Film Co., Ltd.) was image exposed and developed by a full-automatic processor, ELP 404V (trade name, made by Fuji Photo Film Co., Ltd.) using each of the liquid developers. The processing speed (plate-making speed) was 5 plates/minute. Furthermore, the occurrence of stains of the developing apparatus by sticking of the toner after processing 2,000 plates of ELP Master II Type was checked. The blackened ratio (images area) of the duplicated image was determined using 30% original.

The results obtained are shown in Table 16 below.

TABLE 16

| Test No. | Developer | Stains of Developing Apparatus | Image of the 2,000th Plate |
|---|---|---|---|
| 1 | Developer of Example | No toner residue adhered | Clear |
| 2 | Developer 2-A | Toner residue greatly adhered | Letter parts lost, density of solid black part lowered, background fogged |
| 3 | Developer 2-B | Toner residue adhered slightly | Density of fine lines slightly lowered, Dmax lowered |
| 4 | Developer 2-C | Toner residue adhered | Density of fine lines slightly lowered, Dmax lowered |

When each of the liquid developers was used for plate making under the aforesaid processing conditions, only the liquid developer to this invention caused no stains of the developing apparatus and gave clear images on the 2,000th plate.

Then, the offset printing master plate (ELP Master) prepared by processing using each of the liquid developers was used for printing in a conventional manner and the number of prints obtained before the occurrences of defects of letters on the images of the print, the lowering of the density of the solid black portions of the images, etc., was checked. The results showed that the master plate obtained by using each of the liquid developer of this invention and the liquid developers in Comparison Examples A-2 and C-2 gave more than 10,000 prints without accompanied by the aforesaid failures, while the master plate prepared using Comparison Liquid Developer 2-B results in the failures after ,000 prints.

As is clear from the aforesaid results, only the liquid developer of this invention could advantageously be used for preparing a large number of prints by the master plate obtained without causing stains of the developing apparatus.

In the case of using Comparison Liquid Developer 2-A, there was no problem on the number of prints but the developing apparatus was too stained to further use continuously.

Also, in the cases of Comparison Liquid Developers 2-B and 2-C, the developing apparatus was stained (in particular, on the back surface of the electrode plate) when the developer was used under the condition of a rapid processing speed of 5 plates/minute (an ordinary processing speed was 2 or 3 plates/minutes) and after the formation of about 2,000 plates, the image quality of the duplicated images on the plate was reduced (the reduction of Dmax, lowering of the density of fine lines, etc.). There was no problem on the number of prints by the master plate in the case of using Comparison Liquid Developer 2-C but the number thereof was reduced in the case of using Comparison Liquid Developer 2-B.

These results show that the resin grains of this invention are clearly excellent.

EXAMPLE 29

A mixture of 100 g of the white dispersion obtained in Production Example 2 of latex grains and 1.5 g of Sumikalon Black was heated to 100° C. with stirring for 4 hours. After cooling to room temperature, the reaction mixture obtained was passed through a 200 mesh nylon cloth to remove the remaining dye, thereby a black resin dispersion having a means grain size of 0.20 μm was obtained.

A liquid developer was prepared by diluting 32 g of the aforesaid black resin dispersion, 20 g of a higher alcohol, FOC-1400 (trade name, made by Nissan Chemical Industries, Ltd.), and 0.05 g of zirconium naphthenate, with one liter of Shellsol 71.

When the liquid developer was applied to the same developing apparatus as in Example 28 for development, no occurrence of stains of the developing apparatus by sticking of the toner was observed even after developing 2,000 plates.

Also, the image quality of the offset printing master plate obtained was clear and the image quality of the 10,000th print obtained using the master plate was very clear.

EXAMPLE 30

A mixture of 100 g of the white dispersion obtained in Production Example 36 of latex grains and 3 g of Victoria Blue B was heated to a temperature of from 70° C. to 80° C. with stirring for 6 hours. After cooling to room temperature, the reaction mixture obtained was passed through a 200 mesh nylon cloth to remove the remaining dye, whereby a blue resin dispersion having a mean grain size of 0.16 μm was obtained.

A liquid developer was prepared by diluting 32 g of the aforesaid blue resin dispersion, 0.05 g of zirconium naphthenate and 15 g of a higher alcohol, FOC-1600 (trade name, made by Nissan Chemical Industries, Ltd.) with one liter of Isopar H.

When the liquid developer was applied to the same developing apparatus as in Example 1 for development, no occurrence of stains of the developing apparatus by sticking of the toner was observed even after developing 2,000 plates. Also, the image quality of the offset printing master plate obtained was clear and the image quality of the 10,000th print obtained using the master plate was very clear.

EXAMPLE 31

A liquid developer was prepared by diluting 32 g of the white resin dispersion obtained in Production Example 3 of latex grains, 2.5 g of the nigrosine dispersion obtained in Example 28, and 0.02 g of a semidocosanylamidated product of a copolymer of diisobutyrene and maleic anhydride, with one liter of Isopar G.

When the liquid developer was applied to the same developing apparatus as in Example 28 for development, no occurrence of stains of the developing apparatus by sticking of the toner was observed. Also, the image quality of the offset printing plate obtained and the image quality of the 10,000th print obtained using the master plate were clear.

Furthermore, when the same processing was performed after allowing to stand the liquid developer for 3 months, the results were same as above.

EXAMPLE 32

In a paint shaker were placed 10 g of poly(decyl methacrylate), 30 g of Isopar H, and 8 g of Alkali Blue together with glass beads followed by dispersing for 2 hours to provide a fine dispersion of Alkali Blue.

Then, a liquid developer was prepared by diluting 30 g of the white resin dispersion D-13 obtained in Production Example 13 of latex grains, 4.2 g of the aforesaid Alkali Blue dispersion, and 0.06 g of a semidocosanylamidated product of a copolymer of diisobutyrene and maleic anhydride, and 15 g of a higher alcohol, FOC-1400, with one liter of Isopar G.

When the liquid developer was applied to the same developing apparatus as in Example 28 for development, the occurrence of stains of the developing apparatus by sticking of the toner was observed. Also, the image quality of the offset printing master plate obtained and the image quality of the 10,000th print obtained using the master plate were very clear.

EXAMPLES 33 to 53

By following the same procedure as Example 32 except that each of the resin grains shown in Table 17 below was used in place of the resin grain D-13, each of liquid developers was prepared.

TABLE 17

| Example | Resin Grains | Example | Resin Grains |
|---|---|---|---|
| 33 | D-4 | 44 | D-16 |
| 34 | D-5 | 45 | D-17 |
| 35 | D-6 | 46 | D-18 |
| 36 | D-7 | 47 | D-22 |
| 37 | D-8 | 48 | D-25 |
| 38 | D-9 | 49 | D-28 |
| 39 | D-10 | 50 | D-29 |
| 40 | D-11 | 51 | D-32 |
| 41 | D-12 | 52 | D-34 |
| 42 | D-14 | 53 | D-35 |
| 43 | D-15 | | |

When each of the liquid developers was applied to the same developing apparatus as in Example 28 for development, no occurrence of stains of the developing apparatus for development by sticking of the toner was observed even after developing 2,000 plate.

Also, the image quality of the offset printing master plates obtained was clear and the image quality of the 10,000th print obtained using each of the master plates was very clear.

While the invention has been described in detail and with reference to specific embodiments thereof, it will be apparent to one skilled in the art that various changes and modifications can be made therein without departing from the spirit and scope thereof.

What is claimed is:

1. A liquid developer for electrostatic photography comprising resin grains dispersed in a non-aqueous solvent having an electric resistance of at least $10^9$ Ωcm and a dielectric constant of not higher than 3.5, wherein the dispersed resin grains are copolymer resin grains obtained by polymerizing a solution containing at least one monofunctional monomer (A) which is soluble in the aforesaid non-aqueous solvent but becomes insoluble after being polymerized, in the presence of a dispersion-stabilizing resin which is soluble in the non-aqueous solvent and is a polymer having a recurring unit represented by following formula (I), a part of which has been crosslinked, and having an acid group selected from $-PO_3H_2$, $-SO_3H$, $-COOH$, $-OH$, $-SH$, and

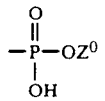

(wherein $Z^0$ represents a hydrocarbon group) bonded to only one terminal of at least one polymer main chain:

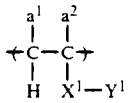

(I)

wherein $X^1$ represents —COO—, —OCO—, $-CH_2OCO-$, $-CH_2COO-$, —O—, or $-SO_2-$; $Y^1$ represents an aliphatic group having from 6 to 32 carbon atoms; and $a^1$ and $a^2$, which may be the same or different, each represents a hydrogen atom, a halogen atom, a cyano group, a hydrocarbon group having from 1 to 8 carbon atoms, $-COO-Z^1$ or $-COO-Z^1$ bonded via a hydrocarbon group having from 1 to 8 carbon atoms (wherein $Z^1$ represents a hydrocarbon group having from 1 to 22 carbon atoms); and at least one oligomer (B) having a number average molecular weight of not more than $10^4$ and having at least one polar group selected from a carboxy group, a sulfo group, a hydroxy group, a formyl group, an amino group, a phosphono group, and

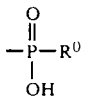

wherein $R^0$ represents a hydrocarbon group or $-OR^1$ (wherein $R^1$ represents a hydrocarbon group bonded to only one terminal of the main chain of a polymer composed of a recurring unit represented by following formula (II):

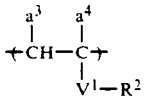

(II)

wherein $V^1$ represents —COO—, —OCO—, $-(CH_2)_lCOO-$, $-(CH_2)_lOCO-$, —O—, $-SO_2-$, —CONHCOO—, —CONHCONH—,

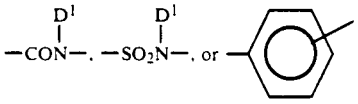

(wherein $D^1$ represents a hydrogen atom or a hydrocarbon group having from 1 to 22 carbon atoms and represents an integer of from 1 to 3); $R^2$ represents a hydrocarbon group having from 1 to 22 carbon atoms, said $R^2$ may have —O—, —CO—, $-CO_2-$, —OCO—, $-SO_2-$,

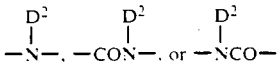

wherein $D^2$ has the same meaning as $D^1$ described above); $a^3$ and $a^4$, which may be the same or different, each represents a hydrogen atom, a halogen atom, a cyano group, a hydrocarbon group having from 1 to 8 carbon atoms, $-COO-D^3$, or $-COO-D^3$ bonded through a divalent hydrocarbon group having from 1 to 8 carbon atoms (wherein $D^3$ represents a hydrogen atom or a hydrocarbon group having from 1 to 8 carbon atoms which may be substituted).

2. The liquid developer for electrostatic photography as in claim 1, wherein the recurring unit shown by the formula (II) in the aforesaid oligomer (B) includes at least a recurring unit represented by following formula (IIa):

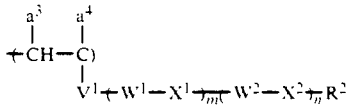

(IIa)

wherein $a^3$, $a^4$, and $V^1$ are same as those in formula (II); $R^5$ represents a hydrogen atom or a hydrocarbon group having from 1 to 22 carbon atoms; $X^1$ and $X^2$, which may be the same or different, each represents —O—, —CO—, $-CO_2-$, —OCO—, $-SO_2-$,

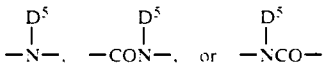

(wherein $D^5$ has the same meaning as $D^1$ in formula (II)); $W^1$ and $W^2$, which may be the same or different, each represents a hydrocarbon group having from 1 to 18 carbon atoms, which may be substituted or may have

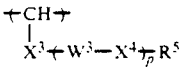

(wherein $X^3$ and $X^4$, which may be the same or different, have the same significance as $X^1$ and $X^2$ described above; $W^3$ represents a hydrocarbon atom having from 1 to 18 carbon atoms, which may be substituted; and m, n, and p each represents an integer of from 0 to 3, with the proviso that m, n and p cannot be 0 at the same time.

3. A liquid developer for electrostatic photography as in claim 1, wherein said monofunctional monomer is represented by the formula (III):

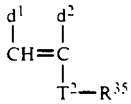

(III)

wherein $T^2$ represents —COO—, —OCO, $-CH_2OCO-$, $-CH_2COO-$, —O—,

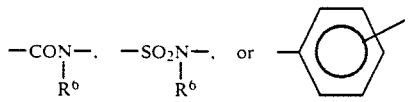

(wherein $R^6$ represents a hydrogen atom or an aliphatic group having from 1 to 18 carbon atoms), $R^{35}$ represents a hydrogen atom or an aliphatic group having from 1 to 6 carbon atoms, and $d^1$ and $d^2$, which may be the same or different, each represents a hydrogen atom, a halogen atom, a cyano group, a hydrocarbon group having from 1 to 8 carbon atoms, —COO—$D^3$, or —COO—$D^3$ bonded through a divalent hydrocarbon group having from 1 to 8 carbon atoms (wherein $D^3$ represents a hydrogen atom or a hydrocarbon group having from 1 to 8 carbon atoms which may be substituted).

4. A liquid developer for electrostatic photography as in claim 1, wherein the recurring unit represented by formula (II) is present in the oligomer (B) at a proportion of from about 30% to about 100% by weight.

5. A liquid developer for electrostatic photography as in claim 1, wherein said oligomer (B) is used in an amount of from about 0.05 to about 10% by weight based on the monomer (A).

6. A liquid developer for electrostatic photography as in claim 1, wherein the total amount of the monomer (A) and the oligomer (B) is from about 5 to about 80 parts by weight per 100 parts by weight of the non-aqueous solvent.

7. A liquid developer for electrostatic photography as in claim 1, wherein said resin which is soluble in said non-aqueous solvent is used in an amount of from about 1 to about 100 parts by weight per 100 parts by weight of the total amount of monomers.

8. A liquid developer for electrostatic photography as in claim 1, wherein said developer further contains a colorant.

9. A liquid developer for electrostatic photography as in claim 1, wherein said dispersed resin particles are present in an amount of from 0.5 to 50 parts by weight per 1,000 parts by weight of the carrier liquid.

10. A liquid developer for electrostatic photography as in claim 1, wherein said dispersed resin particles further comprise a colorant.

* * * * *